US012515139B2

(12) United States Patent
Hsu

(10) Patent No.: US 12,515,139 B2
(45) **Date of Patent: *Jan. 6, 2026**

(54) PLUSH TOY WITH INTERNAL SKELETON AND ROTATABLE HEAD

(71) Applicant: Great Eastern Entertainment Co, Compton, CA (US)

(72) Inventor: Kent Hsu, Torrance, CA (US)

( * ) Notice: Subject to any disclaimer, the term of this patent is extended or adjusted under 35 U.S.C. 154(b) by 183 days.

This patent is subject to a terminal disclaimer.

(21) Appl. No.: 18/454,629

(22) Filed: Aug. 23, 2023

(65) Prior Publication Data

US 2023/0405483 A1 Dec. 21, 2023

Related U.S. Application Data

(63) Continuation-in-part of application No. 18/127,953, filed on Mar. 29, 2023, and a continuation-in-part of application No. 18/100,508, filed on Jan. 23, 2023, and a continuation-in-part of application No. 17/832,504, filed on Jun. 3, 2022, now Pat. No. 11,944,915.

(51) Int. Cl.

| | |
|---|---|
| ***A63H 3/16*** | (2006.01) |
| ***A63H 3/02*** | (2006.01) |
| ***A63H 3/04*** | (2006.01) |
| ***A63H 3/46*** | (2006.01) |

(52) U.S. Cl.

CPC ..... *A63H 3/16* (2013.01); *A63H 3/02* (2013.01); *A63H 3/04* (2013.01); *A63H 3/46* (2013.01)

(58) Field of Classification Search

CPC ... A63H 3/02; A63H 3/04; A63H 3/16; A63H 3/46; E21B 17/05; Y10T 403/53

See application file for complete search history.

(56) References Cited

U.S. PATENT DOCUMENTS

| | | | | |
|---|---|---|---|---|
| 1,359,030 A | | 11/1920 | Cabana | |
| 1,374,343 A | | 4/1921 | Wiener | |
| 1,509,604 A | | 9/1924 | Myers | |
| 2,663,971 A | | 12/1953 | Ippolito | |
| 3,099,895 A | * | 8/1963 | Beebe | A63H 3/46 446/376 |
| 3,678,626 A | * | 7/1972 | Heikel | E06B 7/231 49/402 |
| 3,865,437 A | * | 2/1975 | Crosby | E21C 35/197 403/165 |
| 3,982,353 A | | 9/1976 | Christiansen | |
| 4,268,991 A | * | 5/1981 | Cotey | A63H 3/46 446/373 |

(Continued)

FOREIGN PATENT DOCUMENTS

EP 1428563 B1 6/2004

*Primary Examiner* — John A Ricci

(74) *Attorney, Agent, or Firm* — Robert McConnell; McConnell Law Firm PC

(57) ABSTRACT

A plush toy with an internal skeleton and a plastic or PVC head attached with a variety of coupling mechanisms. The plush toy includes a movable and poseable internal skeleton that attaches to a neck connector allowing the use of a plastic or PVC head with the plush body. Detachable hands, feet and head. Includes a unique shoulder design that assists in retention of plush material in the plush toy body. Additionally, four unique head coupling configurations are disclosed that enable connection of a plastic or PVC toy head to a plush body.

17 Claims, 26 Drawing Sheets

(56) References Cited

U.S. PATENT DOCUMENTS

| | | | | | |
|---|---|---|---|---|---|
| 4,571,209 | A | | 2/1986 | Manning et al. | |
| 5,143,500 | A | * | 9/1992 | Schuring | F16B 19/1027 411/339 |
| 5,531,625 | A | * | 7/1996 | Zhong | A63H 3/46 59/80 |
| 5,620,352 | A | * | 4/1997 | Tzong | A63H 3/04 446/120 |
| 5,630,745 | A | * | 5/1997 | Yeh | A63H 3/04 446/385 |
| 5,713,779 | A | | 2/1998 | Chen | |
| 5,762,531 | A | * | 6/1998 | Witkin | A63H 3/04 446/374 |
| 6,010,388 | A | | 1/2000 | Pillai et al. | |
| 6,033,284 | A | | 3/2000 | Rodriguez Ferre | |
| 6,074,270 | A | | 6/2000 | Wilcox et al. | |
| 6,086,447 | A | | 7/2000 | Tucker | |
| 6,110,002 | A | * | 8/2000 | Langton | A63H 3/04 446/373 |
| 6,170,721 | B1 | * | 1/2001 | Chen | A63H 3/003 223/94 |
| 6,220,922 | B1 | * | 4/2001 | Lee | A63H 3/46 446/385 |
| 6,422,916 | B1 | | 7/2002 | Enku | |
| 6,494,763 | B1 | | 12/2002 | Hastey | |
| 6,537,130 | B1 | | 3/2003 | Lee et al. | |
| 6,537,131 | B1 | * | 3/2003 | Larian | A63H 3/46 446/376 |
| 6,932,669 | B2 | | 8/2005 | Lee et al. | |
| 7,479,054 | B2 | * | 1/2009 | Wittenberg | A63H 9/00 446/376 |
| 11,931,665 | B2 | * | 3/2024 | Osculati | A63H 3/44 |
| 11,944,915 | B2 | * | 4/2024 | Hsu | A63H 3/02 |
| 2002/0002022 | A1 | * | 1/2002 | Wilcox | A63H 3/46 446/371 |
| 2002/0055322 | A1 | | 5/2002 | Lee et al. | |
| 2003/0036334 | A1 | | 2/2003 | Shamitoff | |
| 2003/0073376 | A1 | | 4/2003 | Lee | |
| 2004/0002279 | A1 | * | 1/2004 | Wittenberg | A63H 9/00 446/85 |
| 2004/0092203 | A1 | | 5/2004 | Lee et al. | |
| 2007/0281578 | A1 | | 12/2007 | Sambenedetto | |
| 2009/0111354 | A1 | | 4/2009 | Zheng | |
| 2014/0308874 | A1 | | 10/2014 | Rinehart | |
| 2015/0133022 | A1 | | 5/2015 | Ushiba et al. | |

* cited by examiner

PLUSH TOY WITH INTERNAL SKELETON AND ROTATABLE HEAD

BACKGROUND OF THE INVENTION

Field of the Invention

The present invention relates to plush toys, specifically toys consisting of a soft exterior material covering either a soft or firm stuffing material. Plush toys are made of various exterior materials such as soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. These exterior materials are formed of synthetic materials such as polyester, nylon, plastics and/or natural materials such as cotton, wool or real fur. Common stuffing materials may include polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Plush toys are enjoyed by children and adults alike. Children or adults may use them solely for the enjoyment of play but many adults may collect them for enjoyment or financial gain. Plush toys are often based on characters ranging from zoo/farm animals to characters invented by their manufacturers to famous licensed characters such as super heroes or cartoon characters. Plush toys are a significant market enjoyed by those of all ages and all walks of life.

Plush toys well known in the art often have a body and head formed of the same plush material. However, in some circumstances, it is desirable to combine a plush body with a PVC or plastic head for the toy. In the past, this combination has been challenging due to the methods of attaching the plush head versus a PVC head. The present invention addresses these challenges to provide a toy with a plush body and a PVC head.

SUMMARY OF THE INVENTION

The present invention is a novel plush toy with an internal skeleton and a PVC head attached with a variety of coupling mechanisms. The novel plush toy includes a movable and poseable internal skeleton that attaches to a neck connector allowing the use of a PVC head with the plush body. Further, the present invention includes a unique shoulder design that assists in retention of plush material in the plush toy body.

Additionally, four unique head coupling configurations are disclosed that enable connection of a PVC toy head to a plush body. Each of these coupling configurations allow movement of the PVC head as well as removal and reattachment of the head. These coupling configurations include a tabbed prong connector, ball and socket connector, a slotted connector and a threaded connector. These novel additions enable a unique plush toy with PVC head.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

Figure 1:
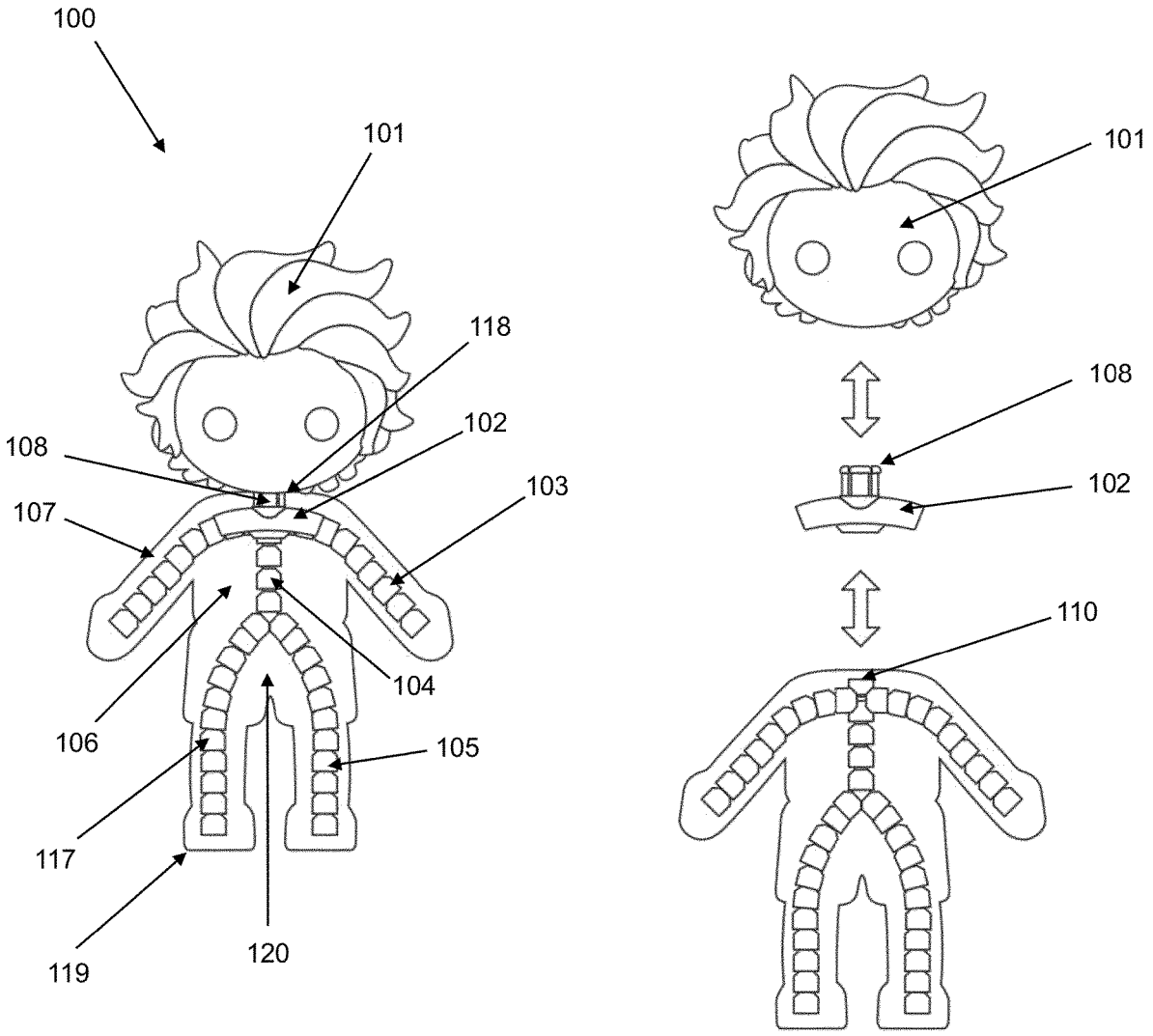
FIG. 1 is a view of the first embodiment of the plush toy with internal skeleton and PVC head.

FIG. 1 is a view of the first embodiment of the present plush toy with internal skeleton and rotatable head 100. Head 101 is the head of the plush toy and in the preferred embodiment is made of PVC (polyvinyl chloride), which is a type of plastic used for dolls. Typically, plush toys are manufactured with heads also made of plush materials, but in this case, PVC is utilized. The use of a PVC head for a plush toy is an improvement that is made possible by the novel head connection apparatuses disclosed herein. This improvement allows the use of molded heads allows the creation of a head model with significantly more detail than a plush head but connected to the soft and enjoyable plush body. While PVC is used in the preferred embodiment, the invention is not so limited and any suitable material could be used such as plastic, rubber, wood, plush or any other material well known in the art for use in the manufacture of dolls.

Plush material retaining shoulder 102 is located at the spot where neck connector 108 of the toy meets the skeleton 107 of the toy. Plush material retaining shoulder 102 is design to assist in retaining the plush material in the body 106 of plush toy 100. Skeleton 107 is comprised of legs 105, arms 103, and spine 104. Each part of skeleton 107 is made up of skeleton pieces 117 that, in the preferred embodiment, are made of plastic with both female and male coupling ends. The male coupling end fits into the female coupling end of another skeleton piece 117 such that they become attached but can also move rotationally within the coupling end. This movement allows skeleton 107 to be moveable and poseable for the enjoyment of the user. The arms, legs and body can be moved into various positions and held there by skeleton 107.

Body 106 is comprised of skeleton 107, stuffing 120 and plush cover 119. Stuffing 120 fits over and around skeleton 107 and provides the soft feeling desired in plush toys. Stuffing 120 is polyester fiber in the preferred embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 119 forms the exterior of the plush toy and includes the preferred exterior design of the toy. Plush cover 119 can be manufactured using any of many methods well known in the art, but in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 119 also includes neck hole 118 where the neck connector 108 fits through plush cover 119.

In the preferred embodiment, neck connector 108 is formed as part of plush material retaining shoulder 102. Plush material retaining shoulder 102 connects to skeleton 107 by skeleton connector 110. Plush material retaining shoulder 102 is also shaped to prevent stuffing 120 from exiting through neck hole 118. It achieves this by the shoulder portion of the plush material retaining shoulder 102 pushing stuffing 120 into the plush body and forming a barrier that prevents stuffing 120 from coming out of neck hole 118. Neck connector 108 and plush material retaining shoulder 102 are formed of plastic in the preferred embodiment, but any suitable material known in the art could be utilized.

Neck connector 108 is designed to couple to head 101 through a variety of coupling types shown in this disclosure. These unique coupling types enable the improvement of attaching a PVC head to a plush body in a plush toy. In this embodiment, neck connector 108 is a tabbed connector that couples with a similarly shaped receptacle connector installed within the base of head 101. In this embodiment, the head 101 snaps onto neck connector 108 (the connection is shown in more detail in a later figure). When snapped onto the neck connector 108, the head 101 is able to rotate in a circular motion around its vertical axis. Further, the head is easily removed and replaced with another head for the enjoyment of its user. With plush material retaining shoulder 102 attached to skeleton connector 110, the body 106 may be filled with stuffing 120 that is retained by plush cover 119. Further, plush material retaining shoulder 102 prevents stuffing 120 from exiting through neck hole 118 in plush cover 119. The easy connection of head 101 to neck connector 108 allows the use of unique and different materials for head 101 including PVC and other plastics. When head 101 is snapped onto neck connector 108 the complete toy is formed, including the plush body 106 and PVC head 101. The head 101 is rotatable around its vertical axis and removable. The body is posable but also retains the desired characteristics of a plush body. The characteristics of this plush toy with PVC head are unique and provide playing enjoyment for the user.

Figure 2:
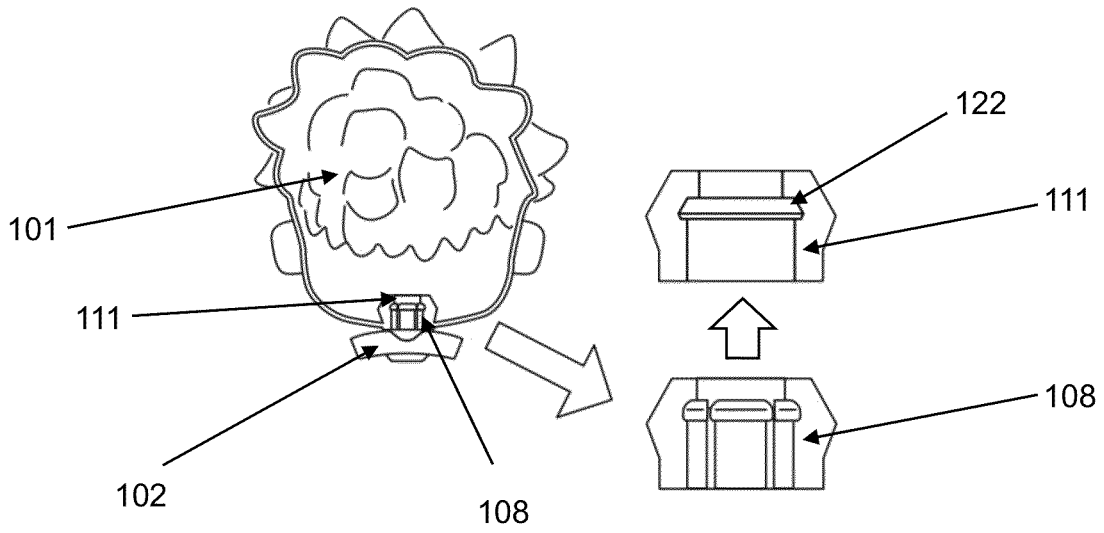
FIG. 2 is a view of the neck connector of the first embodiment of the plush toy with internal skeleton and PVC head.

FIG. 2 shows a view of head 101 with neck connector 108 coupled with neck receptacle 111. In this view, plush material retaining shoulder 102 is also shown connected to neck connector 108. Neck connector 108 is a male connector with four individual tabbed prongs in this embodiment. This neck connector 108 has a base where it is attached to plush material retaining shoulder 102. The tabbed prongs of this connector start at the base and are arranged in substantially circular fashion. Each prong is separated by a small void that allows the prongs to be squeezed apart such that the circumference of the circle formed by the prongs may be increased and the prongs can be pushed over the lip of the neck receptacle. Each prong as a tab at the opposite end from the base.

Neck receptacle 111 is a substantially circular post type connector with lip 122 at one end, designed to couple with neck connector 108. When the prongs of neck connector 108 are expanded, they fit over neck receptacle 111. When pushed along the length of neck receptacle 111, the tab of each prong is pushed over lip 122 of neck receptacle. Once pushed over lip 122, the tabs of the prongs align with lip 122 of neck receptacle 111 to provide a secure fit such that neck connector 108 and neck receptacle 111 are firmly coupled and attached to each other. In this way, head 101 can be attached to plush body 106. While the attachment is secure, the neck connector 108 may still be removed from neck receptacle 111. Also, due to the circular nature of both the connector and receptacle, head 101 may rotate around its vertical axis.

Figure 3:
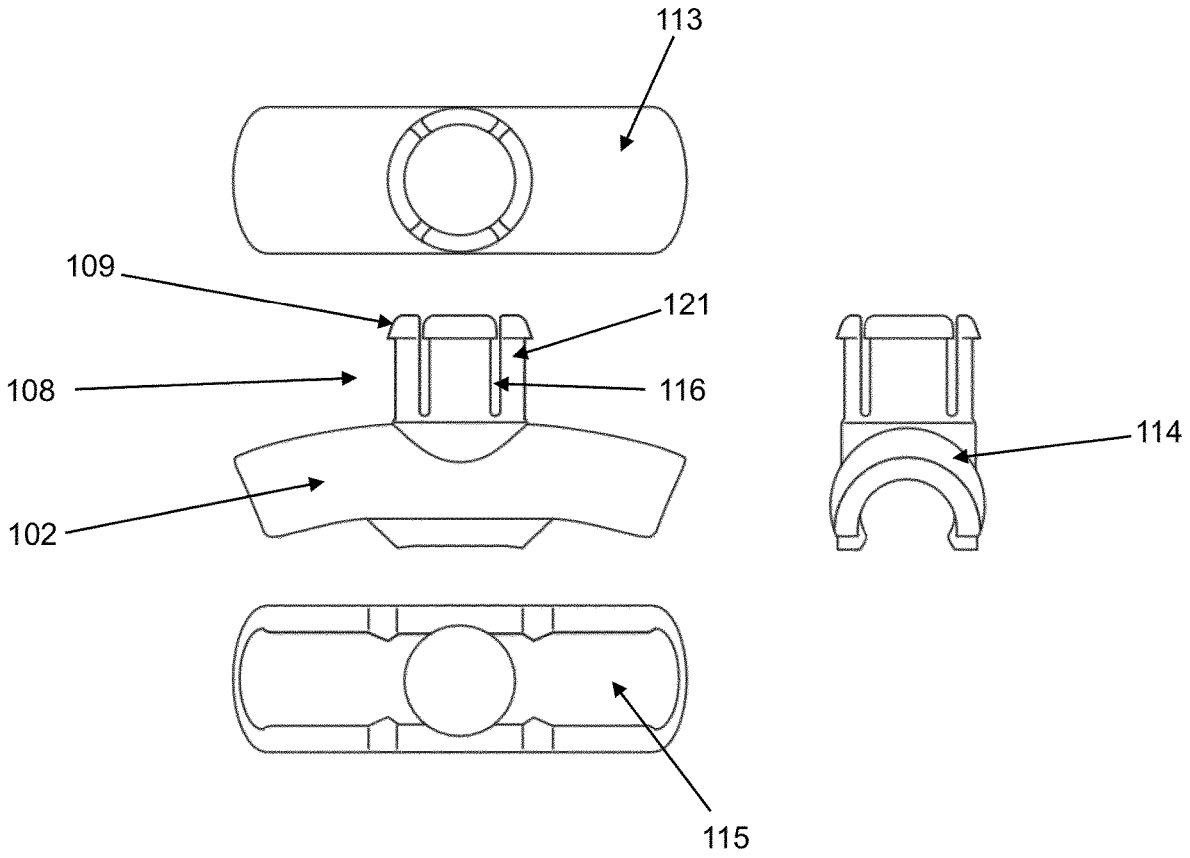
FIG. 3 is a view of the plush material retaining shoulder with first embodiment neck connector of the plush toy with internal skeleton and PVC head.

FIG. 3 shows a detailed view of plush material retaining shoulder 102 and neck connector 108. In this view, prong 121, void 116 and tab 109 of neck connector 108 are clearly visible. Prong 121 is the prong discussed above in relation to FIG. 2 and neck connector 108, as are tab 109 and void 116 related to the discussion above. In this view, shoulder top 113 shows the top portion of plush material retaining shoulder 102. Side shoulder 114 is the side view of plush material retaining shoulder 102. Lastly, bottom shoulder 115 is a bottom view of plush material retaining shoulder 102. In the preferred embodiment, neck connector 108 and plush material retaining shoulder 102 are made of molded plastic, but could be made of any other suitable material well known in the art.

Figure 4:
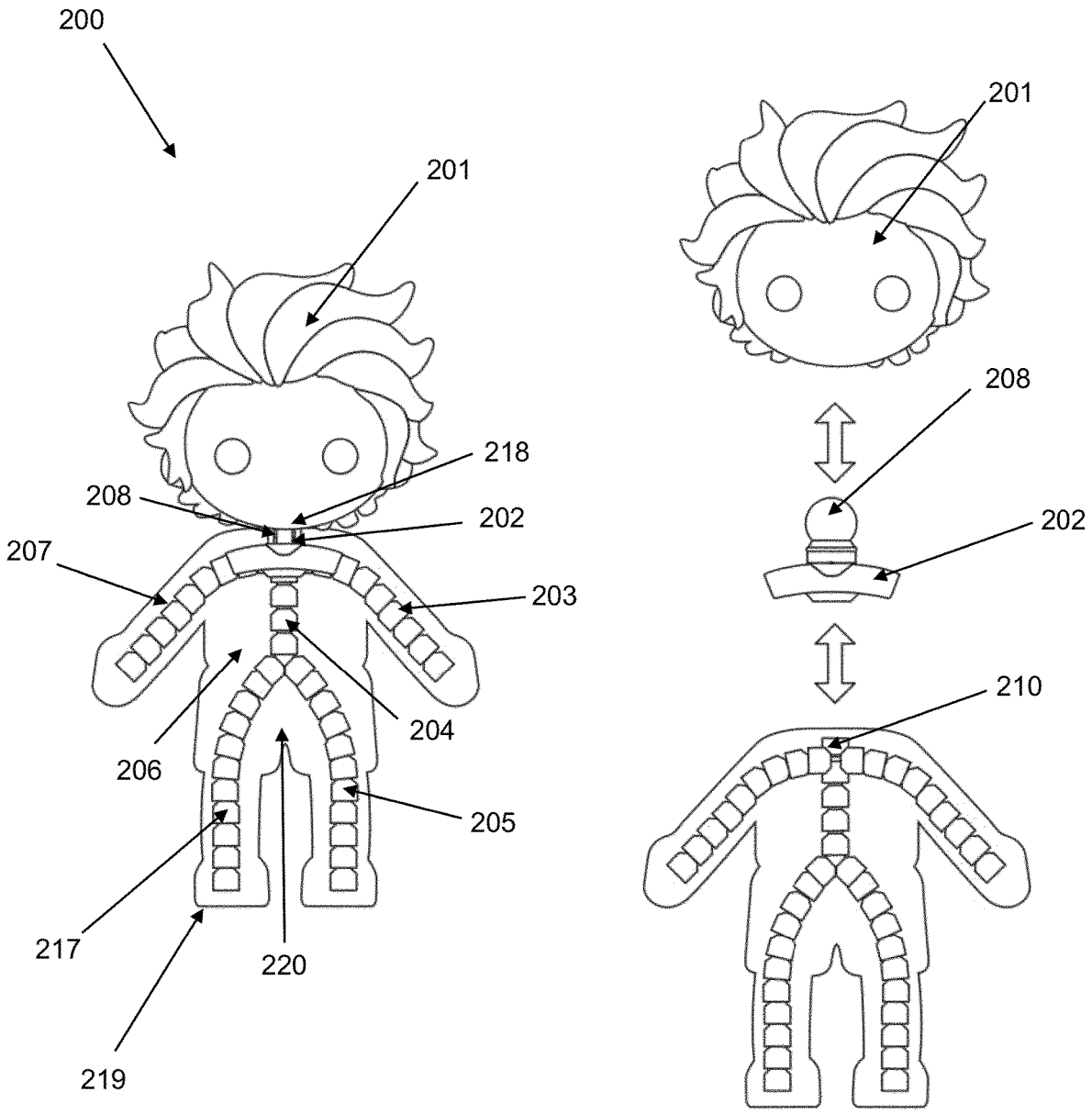
FIG. 4 is a view of the second embodiment of the plush toy with internal skeleton and PVC head.

FIG. 4 displays an alternate embodiment of plush toy with internal skeleton and rotatable head 200 with a ball and socket neck connector 208 for head 201. Head 201 is the head of the plush toy and in this embodiment is made of PVC (polyvinyl chloride), which is a type of plastic used for dolls. Typically, plush toys are manufactured with heads also made of plush materials, but in this case, PVC is utilized. While PVC is used in the preferred embodiment, the invention is not so limited and any suitable material could be used such as plastic, rubber, wood, plush or any other material well known in the art for use in the manufacture of dolls. Plush material retaining shoulder 202 is located at the spot where neck connector 208 of the toy meets the skeleton 207 of the toy. Plush material retaining shoulder 202 is design to assist in retaining the plush material in the body 206 of plush toy 200. Skeleton 207 is comprised of legs 205, arms 203, and spine 204. Each part of skeleton 207 is made up of skeleton pieces 217 that, in the preferred embodiment, are made of plastic with both female and male coupling ends. The male coupling end fits into the female coupling end of another skeleton piece 217 such that they become attached but can also move rotationally within the coupling end. This movement allows skeleton 207 to be moveable and poseable for the enjoyment of the user. The arms, legs and body can be moved into various positions and held there by skeleton 207.

Body 206 is comprised of skeleton 207, stuffing 220 and plush cover 219. Stuffing 220 fits over and around skeleton 207 and provides the soft feeling desired in plush toys. As in the preferred embodiment, stuffing 220 is polyester fiber in this embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 219 forms the exterior of the plush toy and includes the preferred exterior design of the toy. Plush cover 219 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 219 also includes neck hole 218 where the neck connector 208 fits through plush cover 219.

In this embodiment, neck connector 208 is formed as part of plush material retaining shoulder 202. Plush material retaining shoulder 202 connects to skeleton 207 by skeleton connector 210. Plush material retaining shoulder 202 is also shaped to prevent stuffing 220 from exiting through neck hole 218. It achieves this by the shoulder portion of the plush material retaining shoulder 202 pushing stuffing 220 into the plush body and forming a barrier that prevents stuffing 220 from coming out of neck hole 218. Neck connector 208 and plush material retaining shoulder 202 are formed of plastic in this embodiment, but any suitable material known in the art could be utilized.

Neck connector 208 is designed to couple to head 201 through a variety of coupling types shown in this disclosure. In this embodiment, neck connector 208 is a ball connector that couples with a similarly shaped socket connector installed within the base of head 201. In this embodiment, the head 201 snaps onto neck connector 208 (the connection is shown in more detail in a later figure). When snapped onto the neck connector 208, the head 201 is able to rotate in a circular motion around its vertical axis. Further, the head is easily removed and replaced with another head for the enjoyment of its user. With plush material retaining shoulder 202 attached to skeleton connector 210, the body 206 may be filled with stuffing 220 that is retained by plush cover 219. Further, plush material retaining shoulder 202 prevents stuffing 220 from exiting through neck hole 218 in plush cover 219. The easy connection of head 201 to neck connector 208 allows the use of unique and different materials for head 201 including PVC and other plastics. When head 201 is snapped onto neck connector 208 the complete toy is formed, including the plush body 206 and PVC head 201. The head 201 is rotatable around its vertical axis and removable. The body is posable but also retains the desired characteristics of a plush body. The characteristics of this plush toy with PVC head are unique and provide playing enjoyment for the user.

Figure 5:
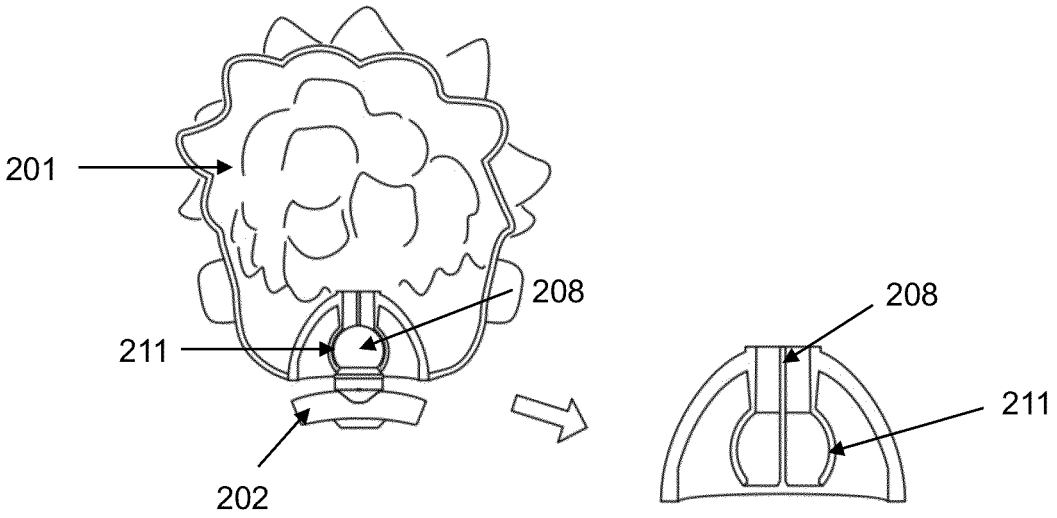
FIG. 5 is a view of the neck connector of the second embodiment of the plush toy with internal skeleton and PVC head.

FIG. 5 shows a view of head 201 with neck connector 208 inserted in neck receptacle 211. In this view, plush material retaining shoulder 202 is also shown connected to neck connector 208. Neck connector 208 is a ball shaped connector in this embodiment. This neck connector 208 has a base where it is attached to plush material retaining shoulder 202. The ball connector of connector 208 is substantially shaped as a ball and is designed to couple with neck receptacle 111 that has an interior shape that is a mirror image of neck connector 208.

The interior of neck receptacle 211 is the mirror image of substantially ball shaped neck connector 208 and is designed to couple with neck connector 208. Neck receptacle 211 is formed of flexible plastic, has an interior that is the inverse of a ball shape with an opening at the lower end of the receptacle. The interior is shaped to couple with the ball of neck connector 208. The receptacle can be expanded to fit the ball of neck connector 208 through the opening of the receptacle. Once pushed through the opening, neck receptacle 211 forms a strong coupling with neck connector 208 that retains the head 201 to the body. This strong coupling, due to the ball shape of neck connector 208 and neck receptacle 211 move freely around its x and y axes.

Figure 6:
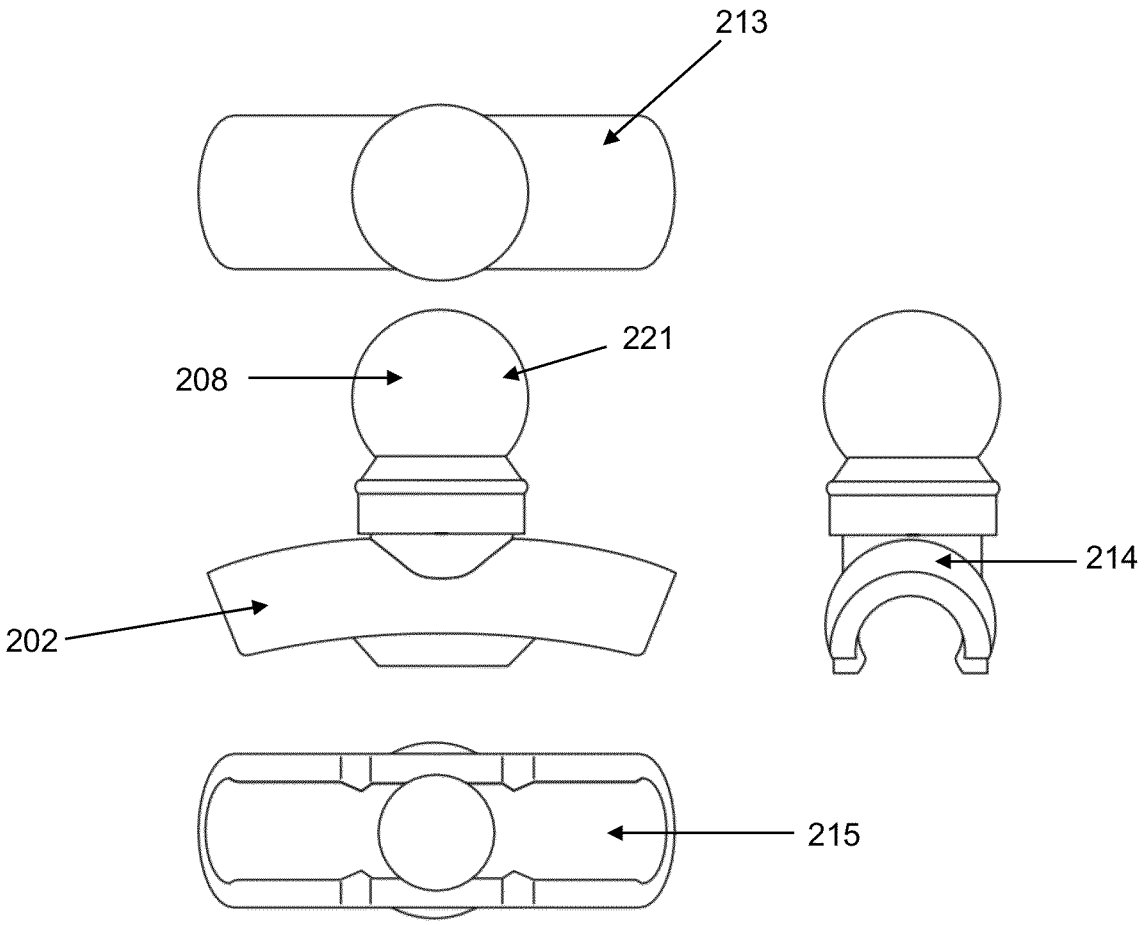
FIG. 6 is a view of the plush material retaining shoulder of the second embodiment of the plush toy with internal skeleton and PVC head.

FIG. 6 shows a detailed view of plush material retaining shoulder 202 and neck connector 208. In this view, ball 221 of neck connector 208 is clearly visible. Ball 221 is discussed in detail in relation to FIG. 5 above. Also in this view, shoulder top 213 shows the top portion of plush material retaining shoulder 202. Side shoulder 214 is the side view of plush material retaining shoulder 202. Lastly, bottom shoulder 215 is a bottom view of plush material retaining shoulder 202. In the preferred embodiment, neck connector 208 and plush material retaining shoulder 202 are made of molded plastic, but could be made of any other suitable material well known in the art.

Figure 7:
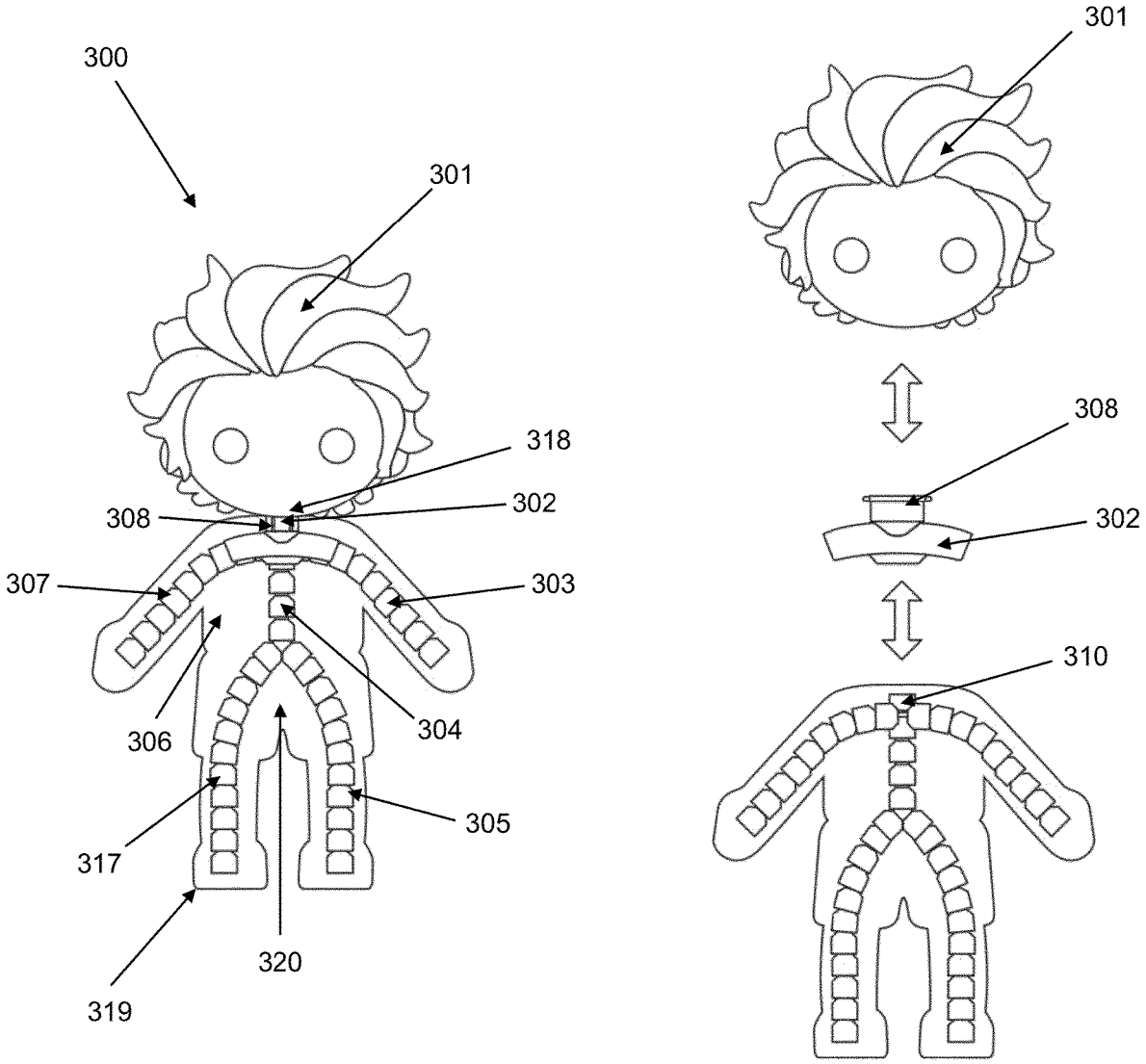
FIG. 7 is a view of the third embodiment of the plush toy with internal skeleton and PVC head.

FIG. 7 displays an alternate embodiment of plush toy with internal skeleton and rotatable head 300 with a slotted neck connector 308 for head 301. Head 301 is the head of the plush toy and in this embodiment, as in the other embodiments described herein, is made of PVC (polyvinyl chloride). Plush material retaining shoulder 302 is located at the spot where neck connector 308 of the toy meets the skeleton 307 of the toy. Plush material retaining shoulder 302 is design to assist in retaining the plush material in the body 306 of plush toy 300. Skeleton 307 is comprised of legs 305, arms 303, and spine 304. Each part of skeleton 307 is made up of skeleton pieces 317 that, in this embodiment, are made of plastic with both female and male coupling ends. The male coupling end fits into the female coupling end of another skeleton piece 317 such that they become attached but can also move rotationally within the coupling end. This movement allows skeleton 307 to be moveable and poseable for the enjoyment of the user. The arms, legs and body can be moved into various positions and held in position by skeleton 307.

Body 306 is comprised of skeleton 307, stuffing 320 and plush cover 319. Stuffing 320 fits over and around skeleton 307 and provides the soft feeling desired in plush toys. As in the preferred embodiment, stuffing 320 is polyester fiber but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 319 forms the exterior of the plush toy and includes the preferred exterior design of the toy. Plush cover 319 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 319 also includes neck hole 318 where the neck connector 308 fits through plush cover 319.

In this embodiment, neck connector 308 is formed as part of plush material retaining shoulder 302. Plush material retaining shoulder 302 connects to skeleton 307 by skeleton connector 310. Plush material retaining shoulder 302 is also shaped to prevent stuffing 320 from exiting through neck hole 318. It achieves this by the shoulder portion of the plush material retaining shoulder 302 pushing stuffing 320 into the plush body and forming a barrier that prevents stuffing 320 from coming out of neck hole 318. Neck connector 308 and plush material retaining shoulder 302 are formed of plastic in this embodiment, but any suitable material known in the art could be utilized.

Neck connector 308 is designed to couple to head 301 through a variety of coupling types shown in this disclosure. In this embodiment, neck connector 308 is a round connector with two rectangularly shaped tabs that extend outwardly from the round connector. Round neck connector with tabs couples with a round slotted connector that is sized to fit over neck connector 308. In this embodiment, the head 301 slides onto neck connector 308 when the tabs on neck connector 308 line up with the slots on the round socket located in head 301 (the connection is shown in more detail in a later figure). When the tabs of neck connector 308 are aligned with the slots in the socket, head 301 slides on to neck connector 308 and is attached to body 306. In this configuration, the head 301 is able to rotate in a circular motion around its vertical axis. Further, the head is easily removed and replaced with another head for the enjoyment of its user. With plush material retaining shoulder 302 attached to skeleton connector 310, the body 306 may be filled with stuffing 320 that is retained by plush cover 319. Further, plush material retaining shoulder 302 prevents stuffing 320 from exiting through neck hole 318 in plush cover 319. The easy connection of head 301 to neck connector 308 allows the use of unique and different materials for head 301 including PVC and other plastics. When head 301 is fitted onto neck connector 308 the complete toy is formed, including the plush body 306 and PVC head 301. The head 301 is rotatable around its vertical axis and removable. The body is posable but also retains the desired characteristics of a plush body. The characteristics of this plush toy with PVC head are unique and provide playing enjoyment for the user.

Figure 8:
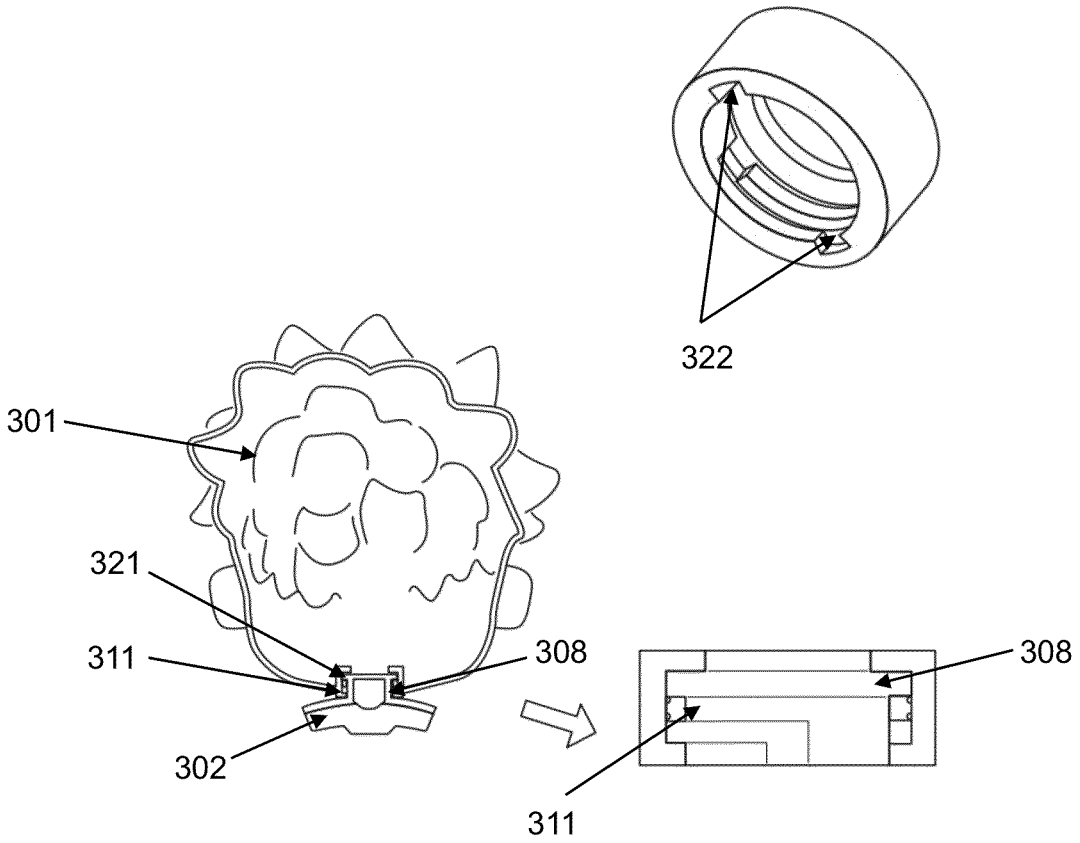
FIG. 8 is a view of the neck connector of the third embodiment of the plush toy with internal skeleton and PVC head.

FIG. 8 shows a view of head 301 with neck connector 308 inserted in neck receptacle 311. In this view, plush material retaining shoulder 302 is also shown connected to neck connector 308. In this embodiment, neck connector 308 has a generally round post shape with two rectangular tabs 321 located at the top of the post. Neck connector 308 has a base where it is attached to plush material retaining shoulder 302. The post of neck connector 308 is generally cylindrical in shape and and is designed to couple with neck receptacle 311 that has an interior shape that also generally cylindrical and designed to fit over neck connector 308. Neck receptacle 311 fits in the base of head 301 and is the means to attach head 301 to body 306.

The interior of neck receptacle 311 is generally shaped as a cylindrical socket, with a size that is slightly greater than that of neck receptacle 311. Further, neck receptacle 311 includes two slots 322 formed from the base of the neck receptacle to channels in the neck receptacle 311. The slots 322 are shaped to couple with the tabs 321 of neck connector 308, and when the tabs 321 of neck connector 308 are aligned with the slots 322 of neck receptacle 311, neck connector 308 slides into neck receptacle 311. Once neck connector 308 is fully inserted in neck receptacle 311, the tabs 321 of neck connector 308 align with the channel at the top of neck receptacle 311. The tabs 321 are able to move in a circular motion around the x axis of the neck receptacle 311. The neck connector 308 and neck receptacle 311 are locked together except when the tabs 321 of neck connector 308 are aligned with the slots of neck connector 311. When the tabs 321 of neck connector 308 are aligned with the slots of neck connector 311, head 301 may be removed from body 306.

Figure 9:
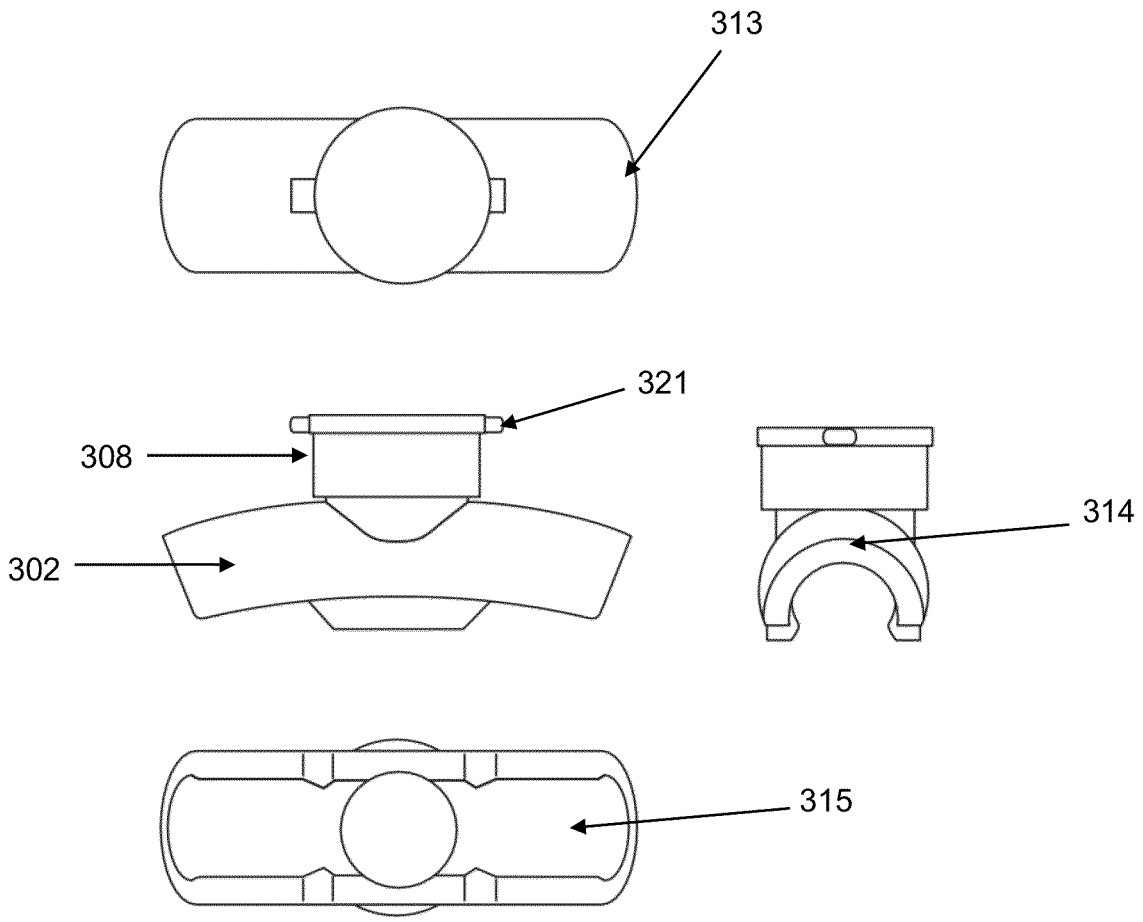
FIG. 9 is a view of the plush material retaining shoulder of the third embodiment of the plush toy with internal skeleton and PVC head.

FIG. 9 shows a detailed view of plush material retaining shoulder 302 and neck connector 308. In this view, tabs 321 of neck connector 308 is clearly visible. Tabs 321 are discussed in detail in relation to FIG. 8 above. Also in this view, shoulder top 313 shows the top portion of plush material retaining shoulder 302. Side shoulder 314 is the side view of plush material retaining shoulder 302. Lastly, bottom shoulder 315 is a bottom view of plush material retaining shoulder 302. In the preferred embodiment, neck connector 308 and plush material retaining shoulder 302 are made of molded plastic, but could be made of any other suitable material well known in the art.

Figure 10:
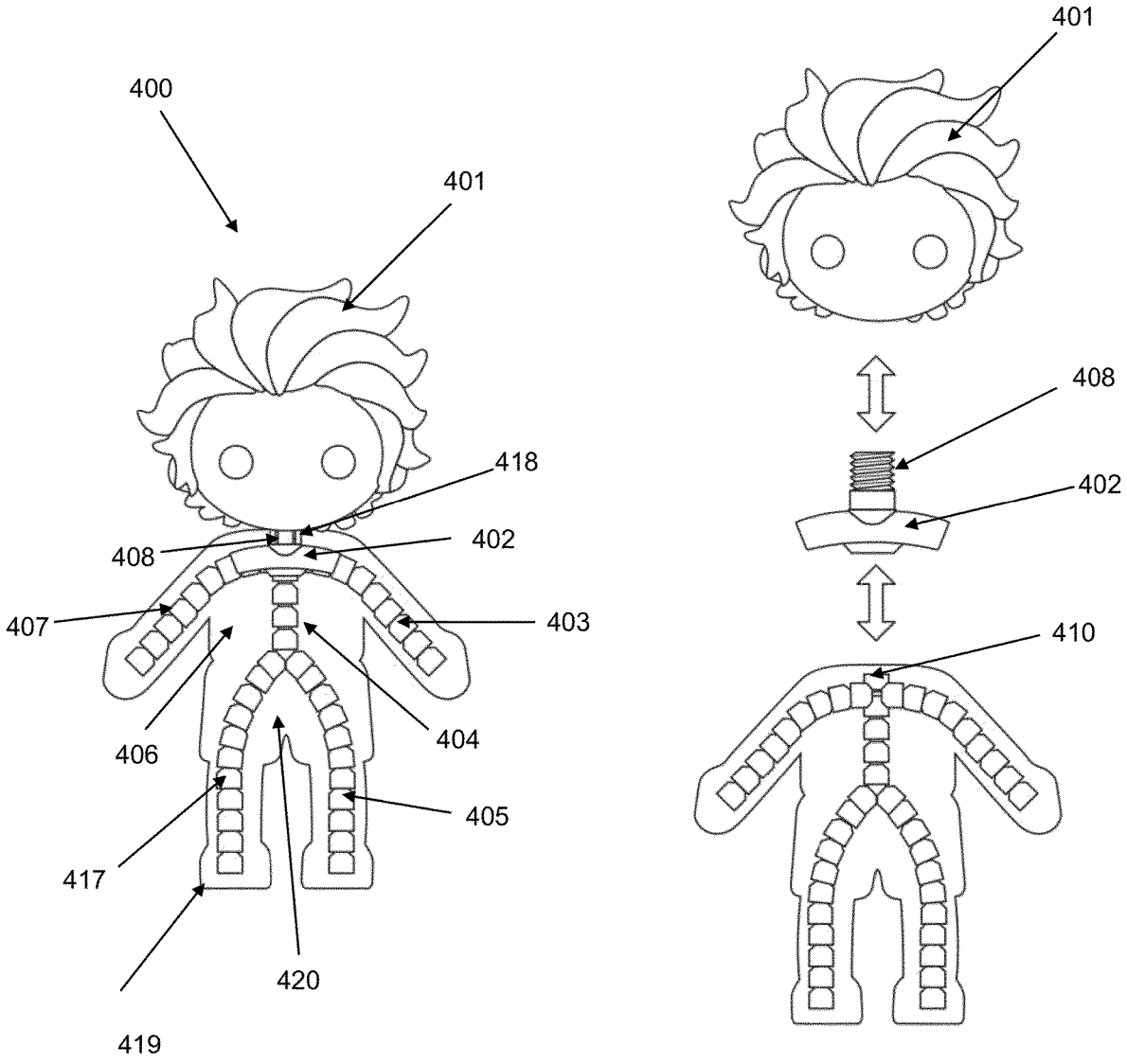
FIG. 10 is a view of the fourth embodiment of the plush toy with internal skeleton and PVC head.

FIG. 10 displays an alternate embodiment of plush toy with internal skeleton and rotatable head 400 with a threaded/screw type neck connector 408 for head 401. Head 401 is the head of the plush toy and in this embodiment, as in the other embodiments described herein, is made of PVC (polyvinyl chloride). Plush material retaining shoulder 402 is located at the spot where neck connector 408 of the toy meets the skeleton 407 of the toy. Plush material retaining shoulder 402 is design to assist in retaining the plush material in the body 406 of plush toy 400. Skeleton 407 is comprised of legs 405, arms 403, and spine 404. Each part of skeleton 407 is made up of skeleton pieces 417 that, in this embodiment, are made of plastic with both female and male coupling ends. The male coupling end fits into the female coupling end of another skeleton piece 417 such that they become attached but can also move rotationally within the coupling end. This movement allows skeleton 407 to be moveable and poseable for the enjoyment of the user. The arms, legs and body can be moved into various positions and held in position by skeleton 407.

Body 406 is comprised of skeleton 407, stuffing 420 and plush cover 419. Stuffing 420 fits over and around skeleton 407 and provides the soft feeling desired in plush toys. As in the preferred embodiment, stuffing 420 is polyester fiber but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 419 forms the exterior of the plush toy and includes the preferred exterior design of the toy. Plush cover 419 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 419 also includes neck hole 418 where the neck connector 408 fits through plush cover 419.

In this embodiment, neck connector 408 is formed as part of plush material retaining shoulder 402. Plush material retaining shoulder 402 connects to skeleton 407 by skeleton connector 410. Plush material retaining shoulder 402 is also shaped to prevent stuffing 420 from exiting through neck hole 418. It achieves this by the shoulder portion of the plush material retaining shoulder 402 pushing stuffing 420 into the plush body and forming a barrier that prevents stuffing 420 from coming out of neck hole 318. Neck connector 408 and plush material retaining shoulder 402 are formed of plastic in this embodiment, but any suitable material known in the art could be utilized.

Neck connector 408 is designed to couple to head 401 through a variety of coupling types shown in this disclosure. In this embodiment, neck connector 408 is threaded screw type connector which attaches to complementary threads in the neck receptacle contained in head 401 In this embodiment, the head 401 rotates onto neck connector 408 with a screwing motion. As the complementary threads in neck connector 408 and neck receptacle travel along their path, head 401 attaches to body 406. In this configuration, the head 401 is able to rotate in a circular motion around its vertical axis. Further, the head is easily removed and replaced with another head for the enjoyment of its user. With plush material retaining shoulder 402 attached to skeleton connector 410, the body 406 may be filled with stuffing 420 that is retained by plush cover 419. Further, plush material retaining shoulder 402 prevents stuffing 420 from exiting through neck hole 418 in plush cover 419. The easy connection of head 401 to neck connector 408 allows the use of unique and different materials for head 401 including PVC and other plastics. When head 401 is fitted onto neck connector 408 the complete toy is formed, including the plush body 406 and PVC head 401. The head 401 is rotatable around its vertical axis and removable. The body is posable but also retains the desired characteristics of a plush body. The characteristics of this plush toy with PVC head are unique and provide playing enjoyment for the user.

Figure 11:
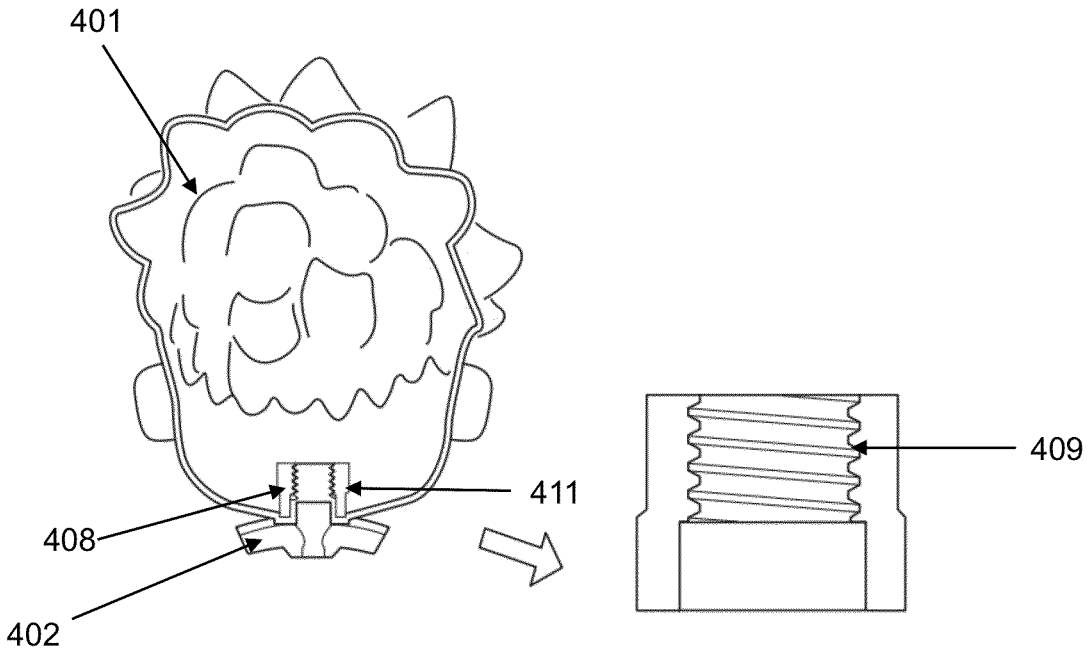
FIG. 11 is a view of the neck connector of the fourth embodiment of the plush toy with internal skeleton and PVC head.

FIG. 11 shows a view of head 401 with neck connector 308 inserted in neck receptacle 411. In this view, plush material retaining shoulder 402 is also shown connected to neck connector 408. In this embodiment, neck connector 408 has a generally round post shape with screw type threads around the exterior. Neck connector 408 has a base where it is attached to plush material retaining shoulder 402. The threaded post of neck connector 308 is designed to couple with complementary threads located in neck receptacle 411. Neck receptacle 411 fits in the base of head 401 and is the means to attach head 401 to body 406.

The interior of neck receptacle 411 is generally shaped as a cylindrical socket, with a size that is slightly greater than that of neck receptacle 411 and internal threads that couple with the external threads of neck connector 408. Once neck connector 408 is inserted in neck receptacle 411, neck connector 408 is rotated so that the external threads of neck connector 408 couple with the internal threads of neck receptacle 411. These coupled threads move along their path until neck connector 408 is firmly seated in neck receptacle 411.

Figure 12:
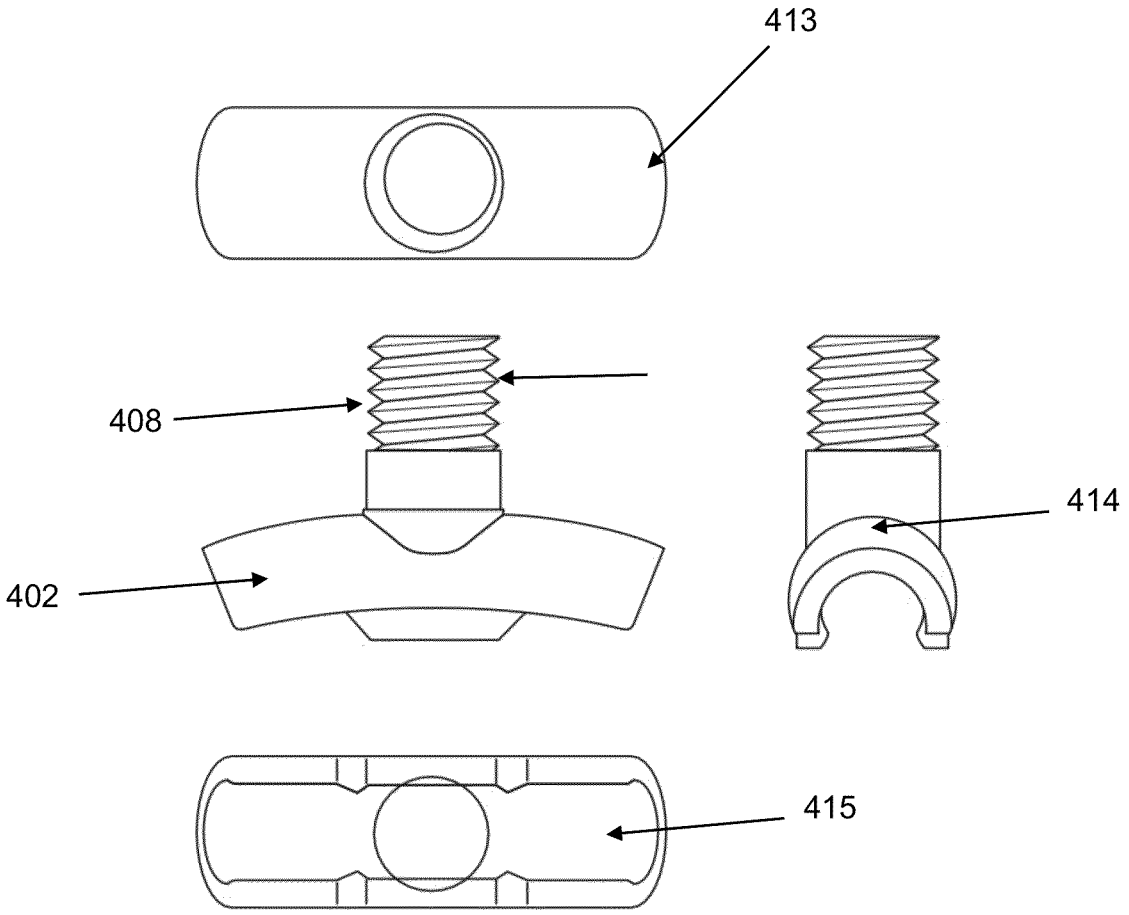
FIG. 12 is a view of the plush material retaining shoulder of the fourth embodiment of the plush toy with internal skeleton and PVC head.

FIG. 12 shows a detailed view of plush material retaining shoulder 402 and neck connector 408. In this view, threads 421 of neck connector 408 are clearly visible. Threads 421 are discussed in detail in relation to FIG. 11 above. Also in this view, shoulder top 413 shows the top portion of plush material retaining shoulder 402. Side shoulder 414 is the side view of plush material retaining shoulder 402. Lastly, bottom shoulder 415 is a bottom view of plush material retaining shoulder 402. In the preferred embodiment, neck connector 408 and plush material retaining shoulder 402 are made of molded plastic, but could be made of any other suitable material well known in the art.

Figure 13:
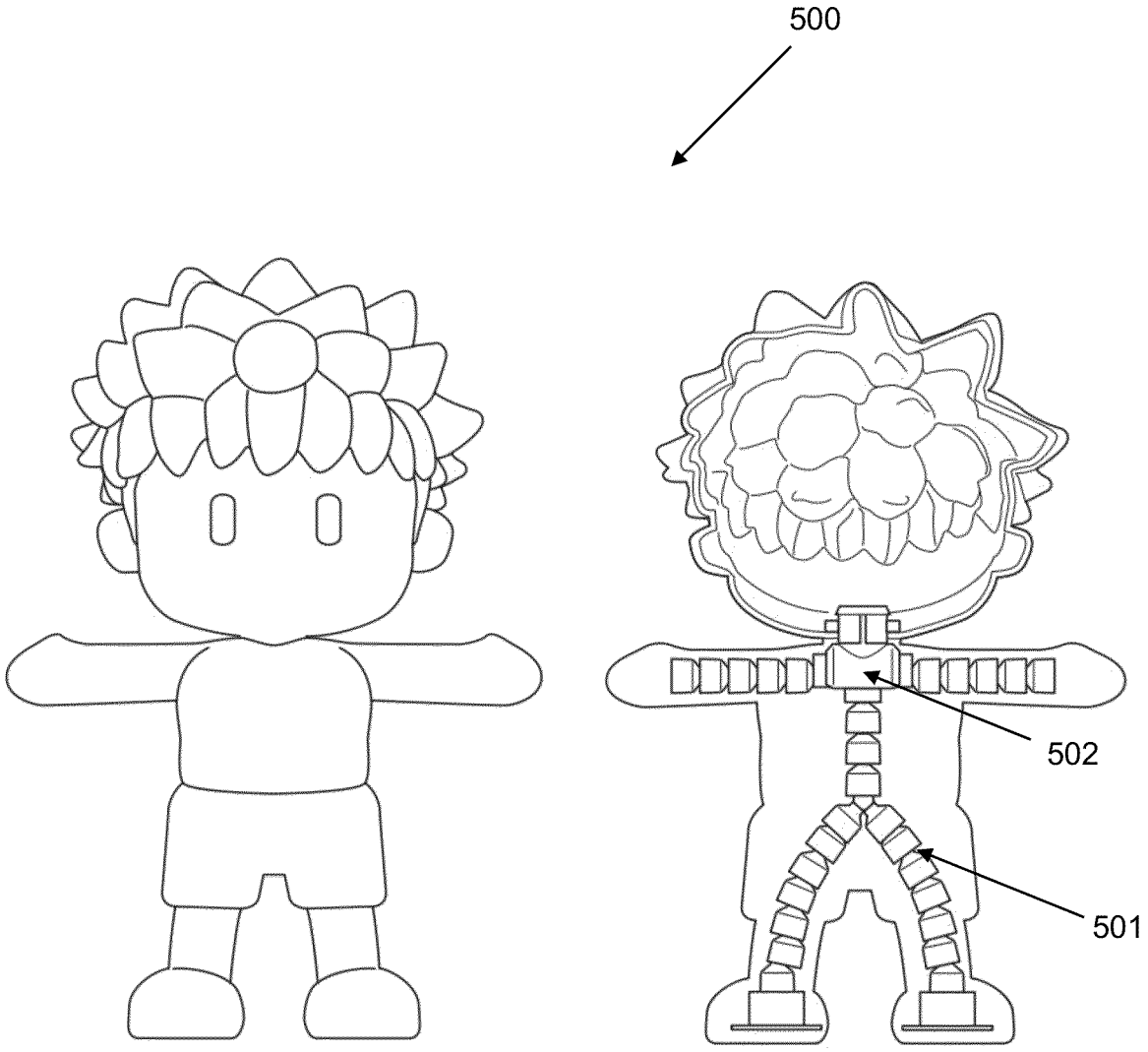
FIG. 13 is a view of the plush toy with an alternative embodiment skeleton.

FIG. 13 shows an alternate embodiment plush toy with internal skeleton and PVC head 500. This embodiment includes central limb connector 502 for skeleton 501 and a novel connection method for the arms, body and head.

Figure 14A:
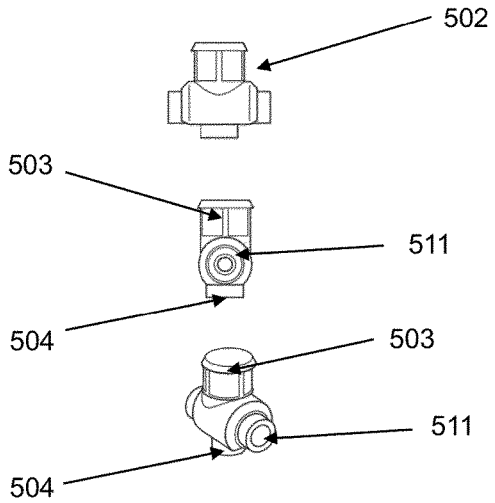
FIG. 14A is a view of a central limb connector for an alternative embodiment skeleton.

FIG. 14A shows a detailed view of central limb connector 502. In this view, neck connector 503, arm connector 511 and body connector 504 are shown. One of the unique features of this embodiment is the connection between the arms/arm connector 511, head/neck connector 503 and body/body connector 504.

Figure 14B:
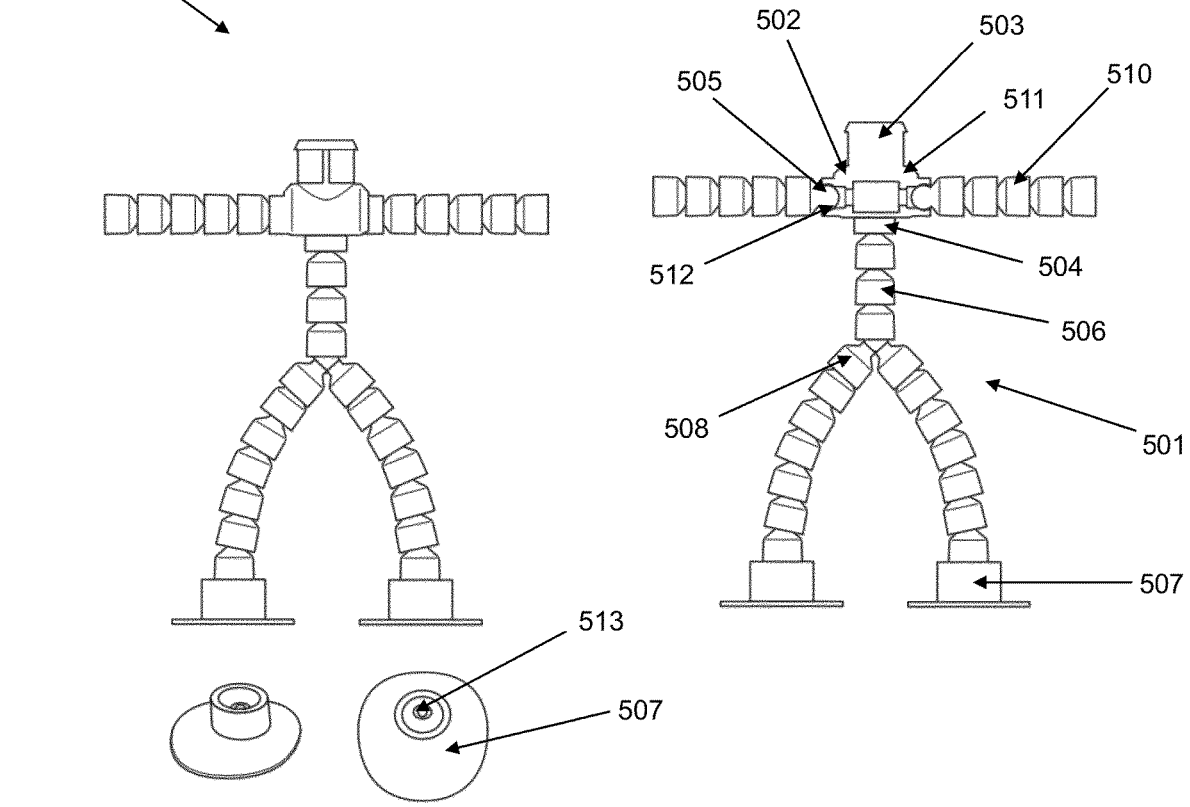
FIG. 14B is a view of an alternative embodiment skeleton.

FIG. 14B shows a detailed view of the internal skeleton of the present embodiment of plush toy 500. Central limb connector 502 provides a central connection for skeleton 501 including arms 510, head (not shown) and body 506. Central limb connector 502 includes neck connector 503, arm connector 511 and body connector 504. Neck connector 503 may be any neck connection means previously disclosed above, but in this view is a tabbed connector such as shown in FIG. 3. This neck connector 503 allows a plush toy head made of PVC material to be attached, detached and rotated on the doll.

Arm connector 511 is a unique ball and socket connector. Arm connector 511 includes a socket connector 512 that is suitably sized to fit a similarly shaped and sized ball connector 505. This ball connector 505 is located on one end of each skeleton piece 508 of the arms 510 and body 506. Each part of skeleton 501, made up of arms 510 and body 506, is constructed of skeleton pieces 508 that, in the preferred embodiment, are made of plastic with both female and male coupling ends. The male coupling end fits into the female coupling end of another skeleton piece 508 such that they become attached but can also move rotationally within the coupling end. In this embodiment, the male coupling end is a ball connector 505 and the female connecting end is a socket connector 512. This movement allows skeleton 501 to be moveable and poseable for the enjoyment of the user. The arms, legs and body can be moved into various positions and held there by skeleton 501. This embodiment also includes stand 507 which is connected to skeleton 501 by stand connector 513. Stand connector 513 snaps onto the female end of skeleton piece 508. In this embodiment, skeleton 501, skeleton pieces 508 and central limb connector 502 are all made of plastic, but any suitable material well known in the art could be used.

Figure 15:
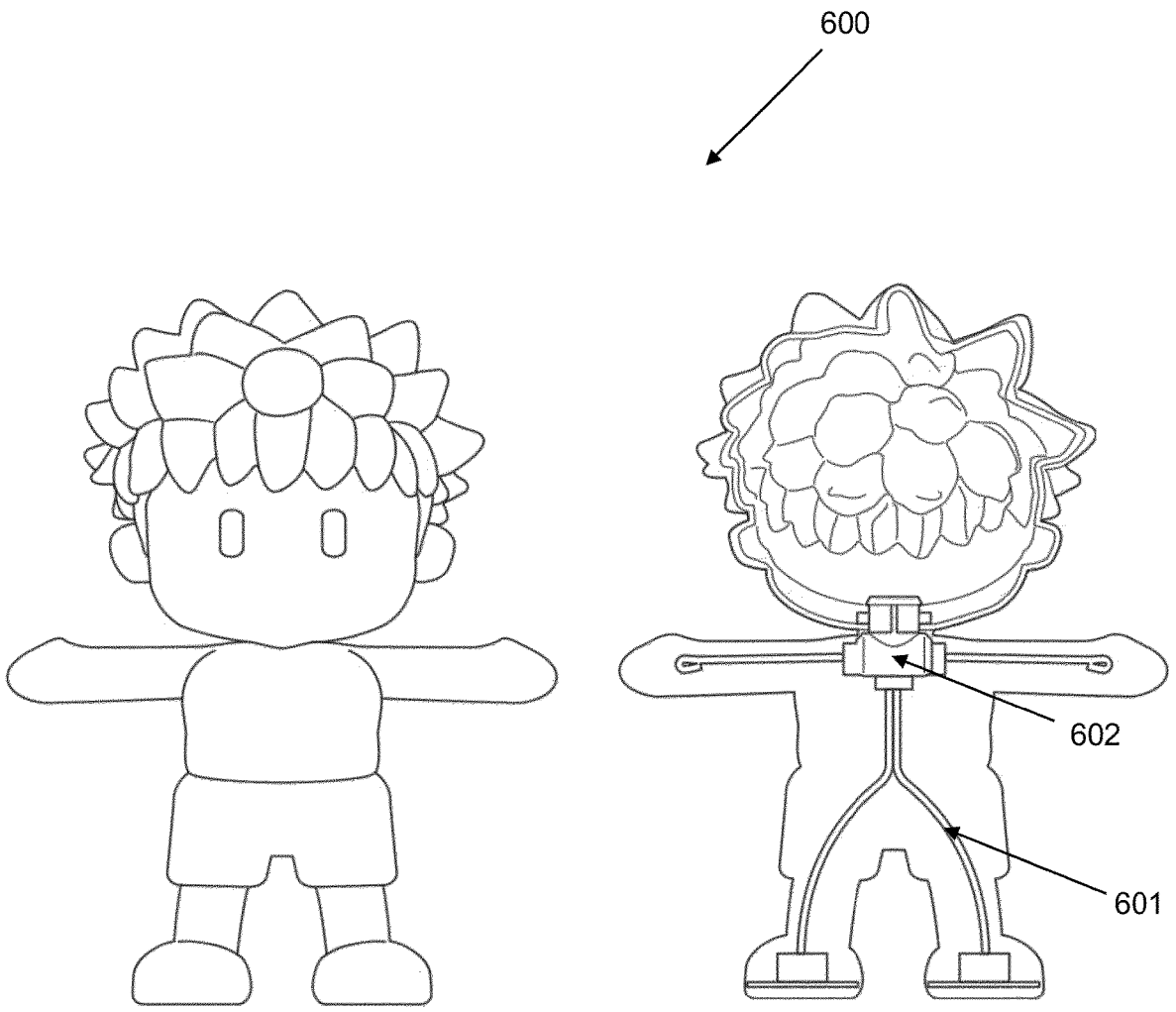
FIG. 15 is a view of a plush toy with an alternative embodiment skeleton made of wire.

FIG. 15 shows an alternate embodiment plush toy with internal skeleton and PVC head 600. This embodiment includes central limb connector 602 for wire skeleton 601 and a novel connection method for the arms, body and head.

Figure 16A:
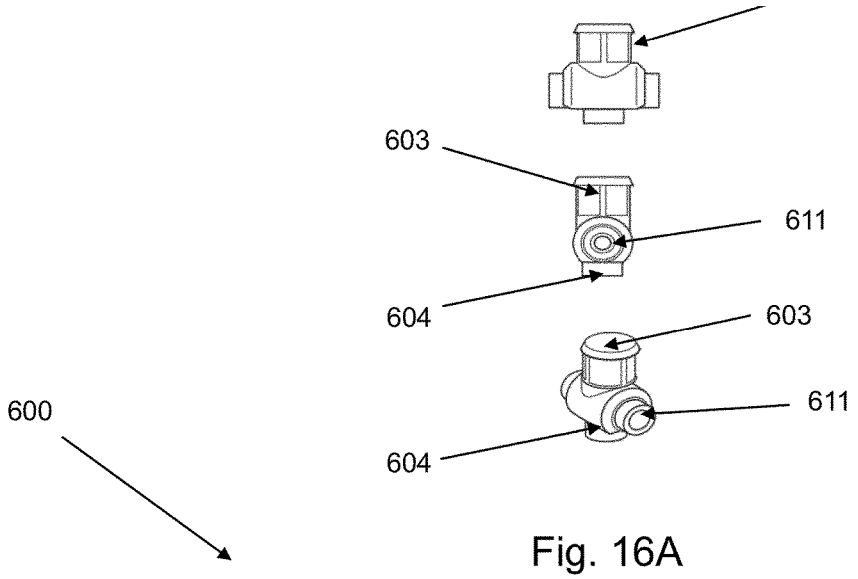
FIG. 16A is a view of a central limb connector for an alternative embodiment wire skeleton.

FIG. 16A shows a detailed view of central limb connector 601. In this view, neck connector 603, arm connector 611 and body connector 604 are shown. One of the unique features of this embodiment is the connection between the arms/arm connector 611, head/neck connector 603 and body/body connector 604.

Figure 16B:
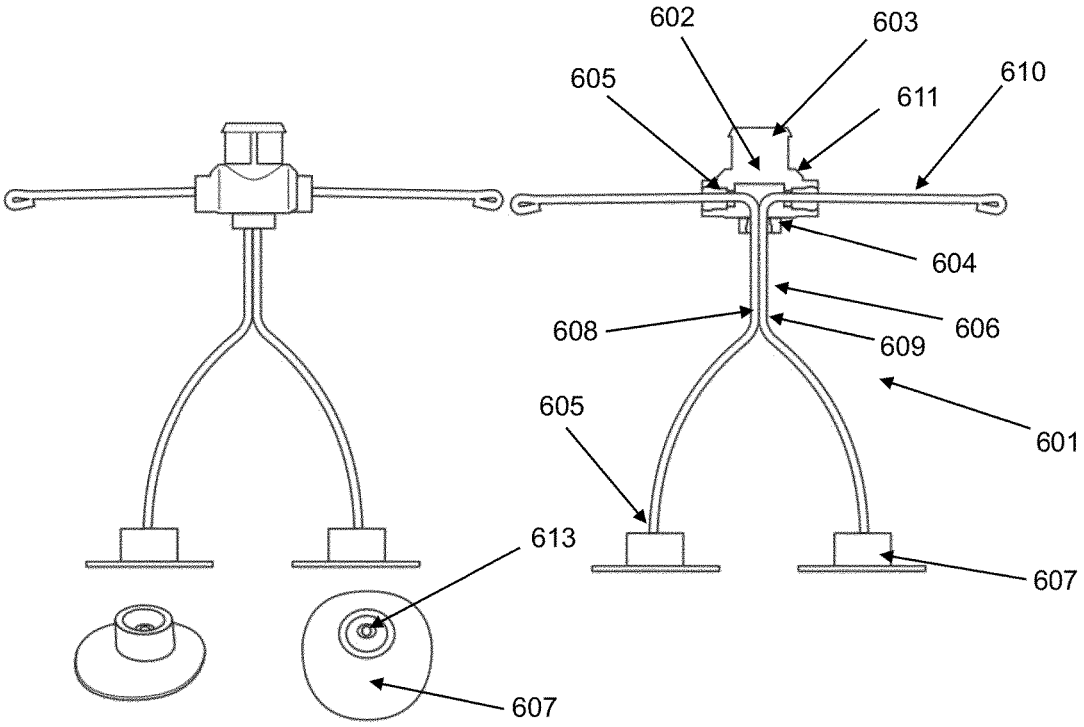
FIG. 16B is a view of an alternative embodiment wire skeleton.

FIG. 16B shows a detailed view of the internal skeleton of the present embodiment of plush toy 600. Central limb connector 602 provides a central connection for skeleton 601 including arms 610, head (not shown) and body 606. Central limb connector 602 includes neck connector 603, arm connector 611 and body connector 604. Neck connector 603 may be any neck connection means previously disclosed above, but in this view is a tabbed connector such as shown in FIG. 3. This neck connector 603 allows a plush toy head made of PVC material to be attached, detached and rotated on the doll.

In this embodiment, skeleton 601 is formed of bendable metal wire. Arms 610 and body 606 are each formed of bendable metal wire. In this embodiment, a first wire 608 forms a first half of the skeleton 601, with the first wire 608 routed from the foot 605 of the skeleton, becoming the body 606, passing through arm connector 611 and becoming arm 610. First wire 608 is formed of a bendable metal wire. A second wire 609 forms the second half of the skeleton 601, with the first wire 609 routed from the foot 605 of the skeleton, becoming the body 606, passing through arm connector 611 and becoming arm 610. Second wire 609 is also formed of a bendable metal wire. First wire 608 and second wire 609 are bonded to each other at the body 606 section of skeleton 601. This bonding may be done with glue, solder, tape or any other suitable adhesive means well known in the art.

In this embodiment, arm connector 611 routes first wire 608 and second wire 609 through from the body 606 section of skeleton 601 to the arm section 610. This routing creates a suitable bend between these sections and allows the arm 601 section to be moved separately from the body 606 section of the skeleton 601. The arms, legs and body can be moved into various positions and held there by skeleton 601. This embodiment also includes stand 607 which is connected to skeleton 601 by stand connector 613. Stand connector 613 snaps onto the end of first wire 608 and/or second wire 609.

In this embodiment, skeleton 601 is formed of a bendable metal wire. This bendable metal wire may have a plastic, rubber or other material cover over the wire. While bendable wire is used in this embodiment, any mailable, formable, or bendable material well known in the art may be used.

Figure 17:
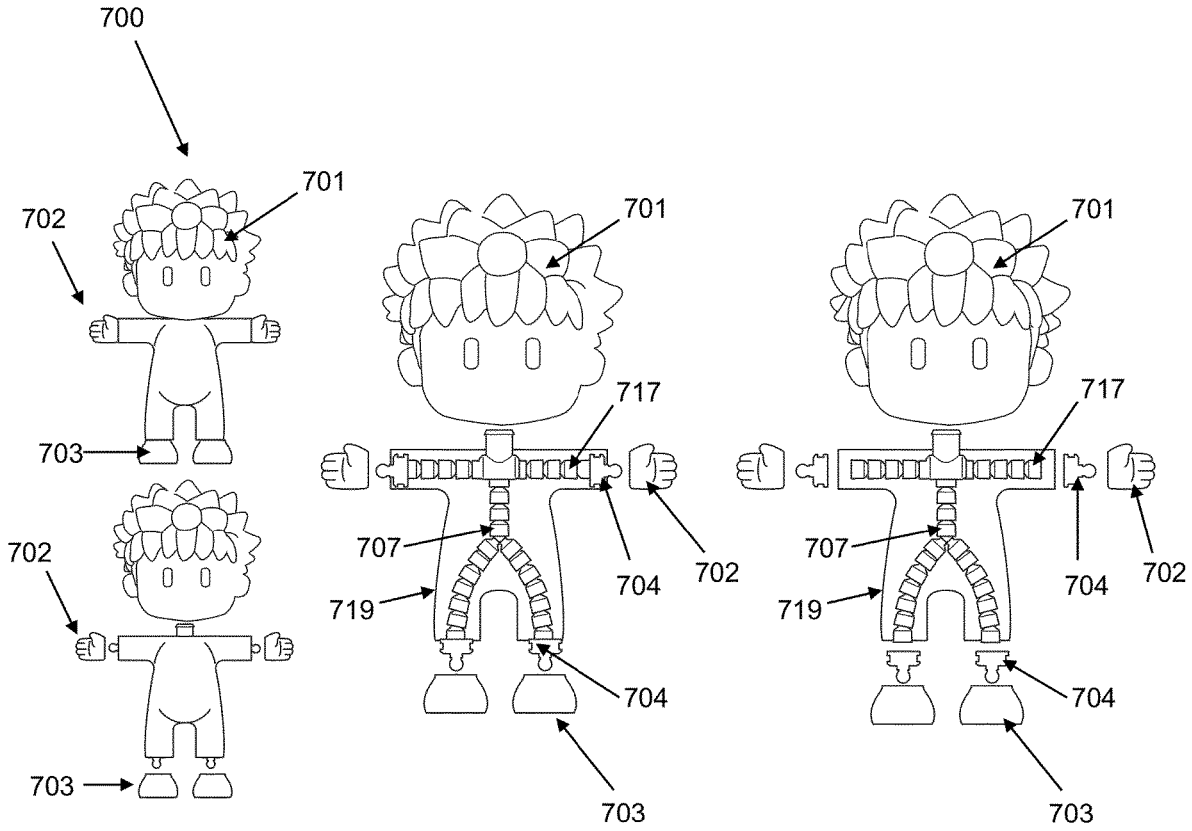
FIG. 17 is a view of an alternative embodiment with attachable and detachable extremities.

FIG. 17 shows an alternate embodiment of the present invention plush toy 700. This embodiment includes hands 702 and feet 703 that are connectable and detachable using an apparatus comprising extremity attachment post 704, attachment band 705 (shown in FIG. 18), hand 702 and foot 703. In this context, extremity means both hands and feet. Extremity attachment post 704 couples to skeleton 707 at a first end and at a second end comprises a post with a rounded knob. Extremity attachment post 704 couples to skeleton 707 by snapping a complementary piece into an end of a skeleton piece 717 where that end is sized to couple with the extremity attachment post 704. The post with the rounded knob of extremity attachment post 704 snaps into a complementary sized receptacle in hand 702 or foot 703.

Plush cover 719 fits over skeleton 707 and is filled with stuffing, which in the preferred embodiment is polyester fiber but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. The hand and foot openings of plush cover 719 are secured over hands 702 and feet 703 with attachment band 705 as shown in FIG. 18.

Figure 18:
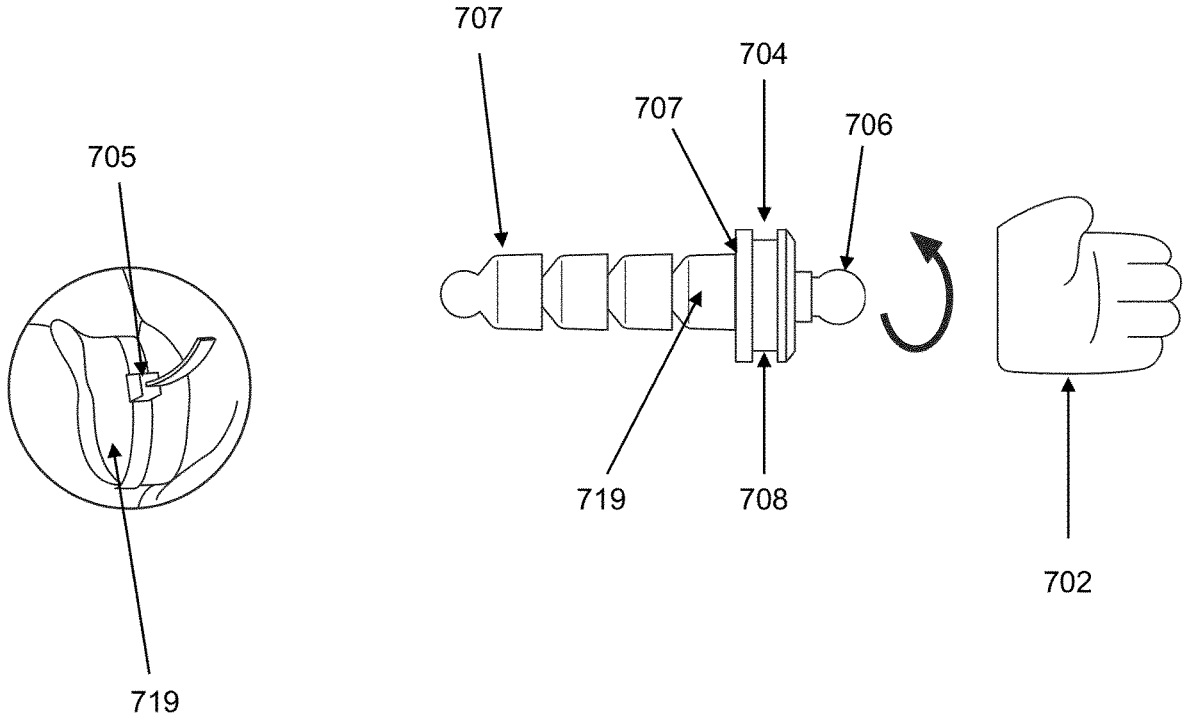
FIG. 18 is a detailed view of the attachable and detachable extremities.

FIG. 18 shows a detailed view of extremity attachment post 704. In this view, the skeleton coupling side 707, rounded knob 706 and band channel 708 are visible. Skeleton coupling side 707 couples with skeleton 707 by snapping into a complementary end of skeleton piece 719. Rounded knob 706 snaps into a complementary sized opening in hand 702 or foot 703. In this way, a hand 702 or foot 703 is attached to the extremity attachment post 704. Band channel 708 forms a secure channel in which attachment band 705 fits and is secured laterally. Plush cover 719 is pulled over extremity attachment post 704 with attachment band 705 fitted over it. Attachment band 705 is tightened to fit within band channel 708. With this configuration, plush cover 719 is securely fit and closed so that any stuffing does not escape. Further, rounded knob 706 allows attachment and removal of extremities, hands and feet, from the plush toy.

Figure 19:
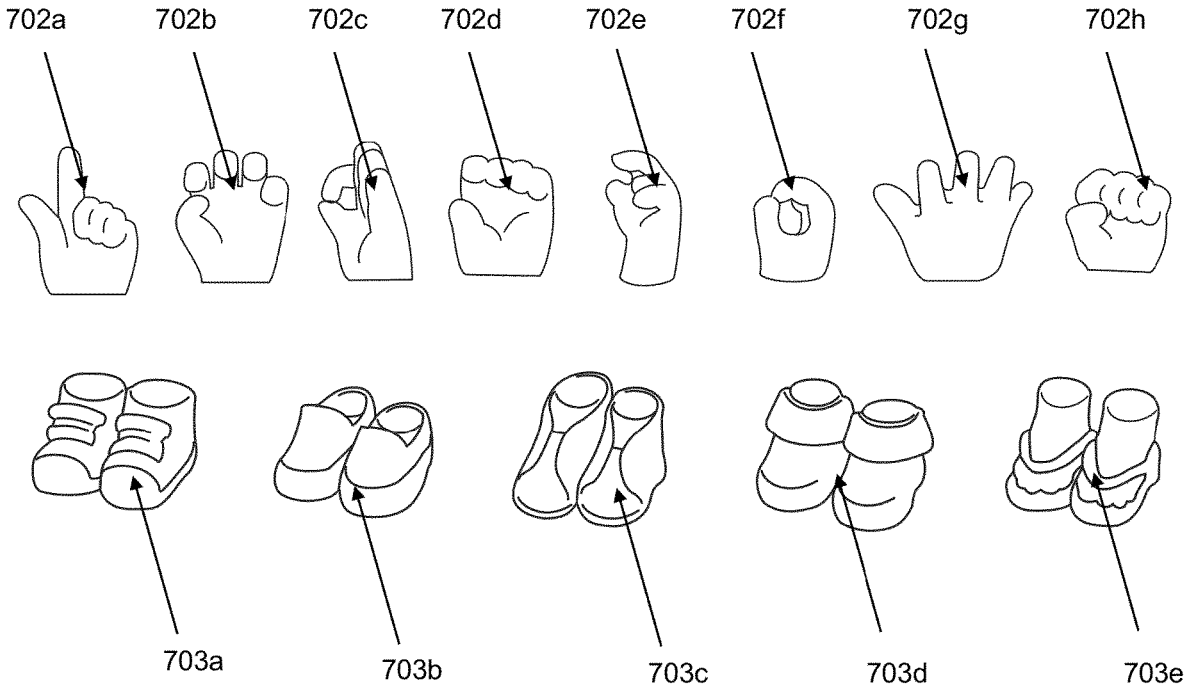
FIG. 19 is a view of a variety of hand gestures and shoe types.

FIG. 19 shows a variety of designs for hands and feet. Design variations of hands showing various gestures are shown in 702*a*-702*h*. Feet variations showing different shoe types are shown in 703*a*-703*e*.

Figure 20:
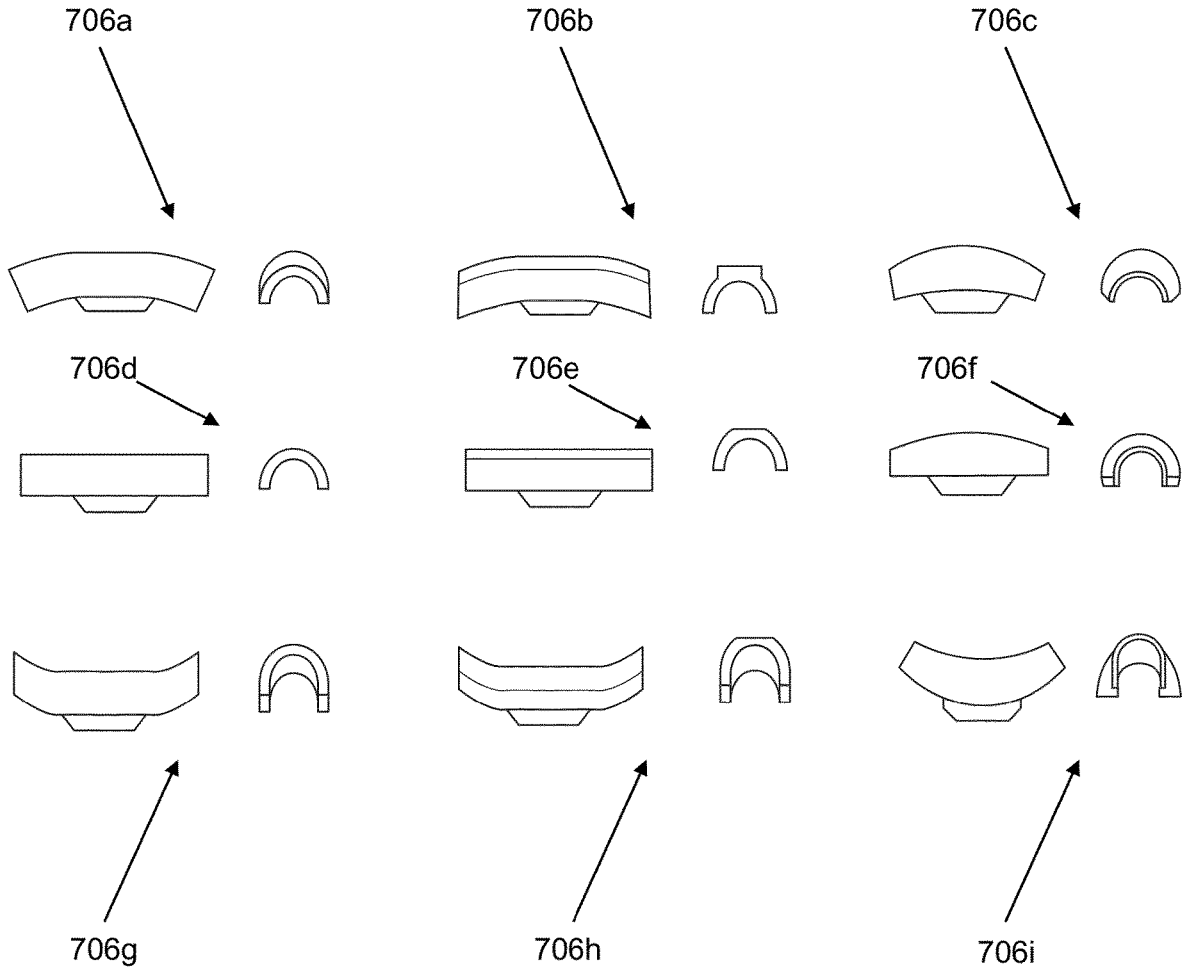
FIG. 20 is a view of a variety of retaining shoulder designs.

FIG. 20 shows a variety of plush material retaining shoulders 706*a*-706*i*. These variations may be used in different configurations of plush toy 700 depending on the design and shape of skeleton 719. Plush material retaining shoulders 706*a*-706*i* prevent plush material, i.e. stuffing from exiting through the neck opening where the head attaches to plush toy 700.

Figure 21:
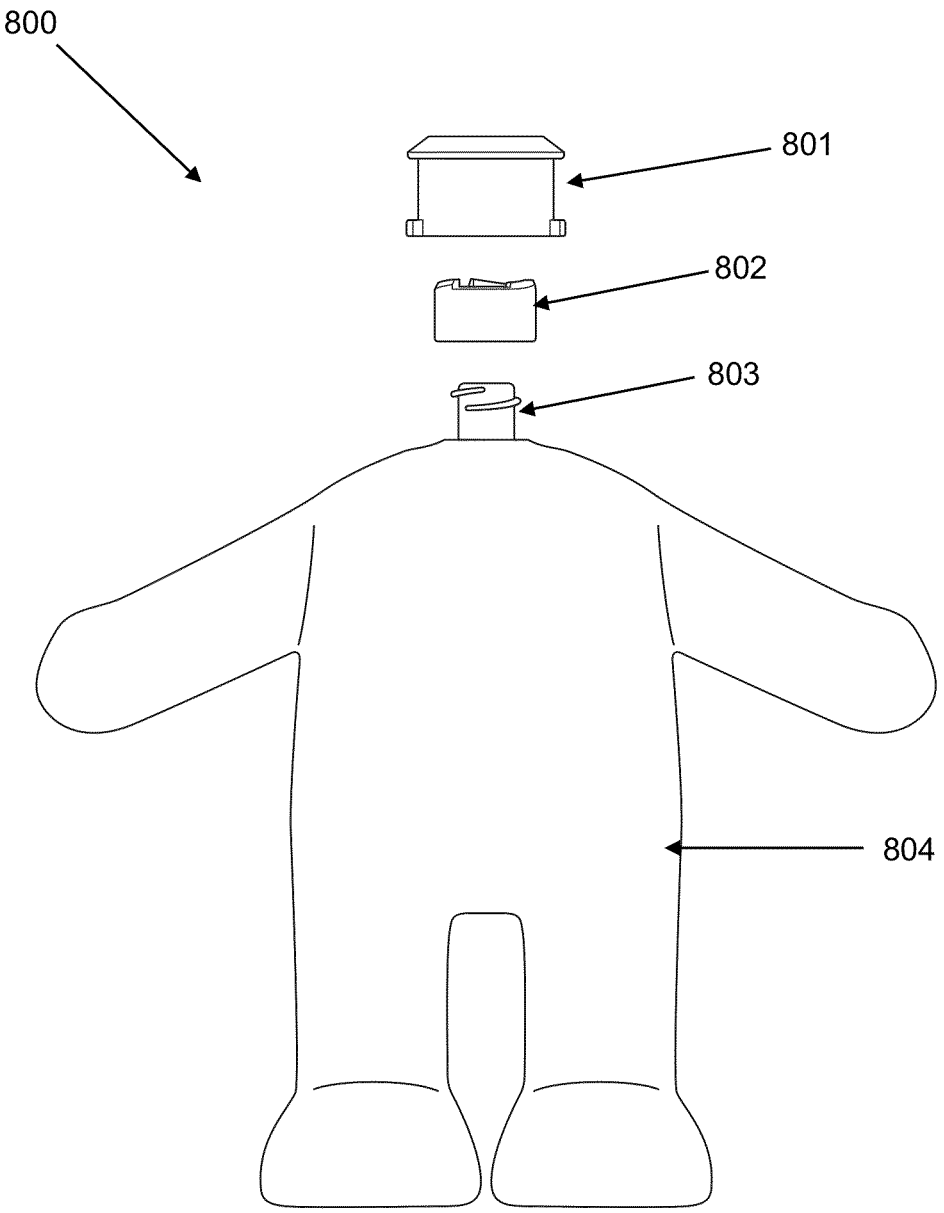
FIG. 21 is a view of an alternative embodiment with an attachable and detachable head.

FIG. 21 shows an alternate embodiment to attach the plastic or PVC head (not shown) to plush toy 800 with a novel head attachment apparatus. This apparatus is comprised of threaded neck post 803, head attachment base 802 and head attachment cover 801. Threaded neck post 803 is attached to retaining shoulder (not shown) which secures it to the internal skeleton. Head attachment base 802 includes a complementary internal thread to secure head attachment base 802 to threaded next post 803. Head attachment base 802 includes keyed slots that match complementary keyed tabs in head attachment cover 801. When the keyed tabs are fitted in the keyed slots and the head attachment cover 801 pressed down and rotated, the keyed tabs and keyed slots snap together, thus locking the head attachment base 802 to head attachment cover 801. Head attachment cover 801 includes a post that fits within the head of the doll (in the preferred embodiment made of PVC or plastic) and tabs that fit within complementary slots in the head. This apparatus enables the head to be attached and removed by pressing down on the head and rotating it, either to lock the keyed tabs and slots together or unlock them from each other. The details of the keyed tabs and slots will be showed in reference to FIG. 22.

Figure 22:
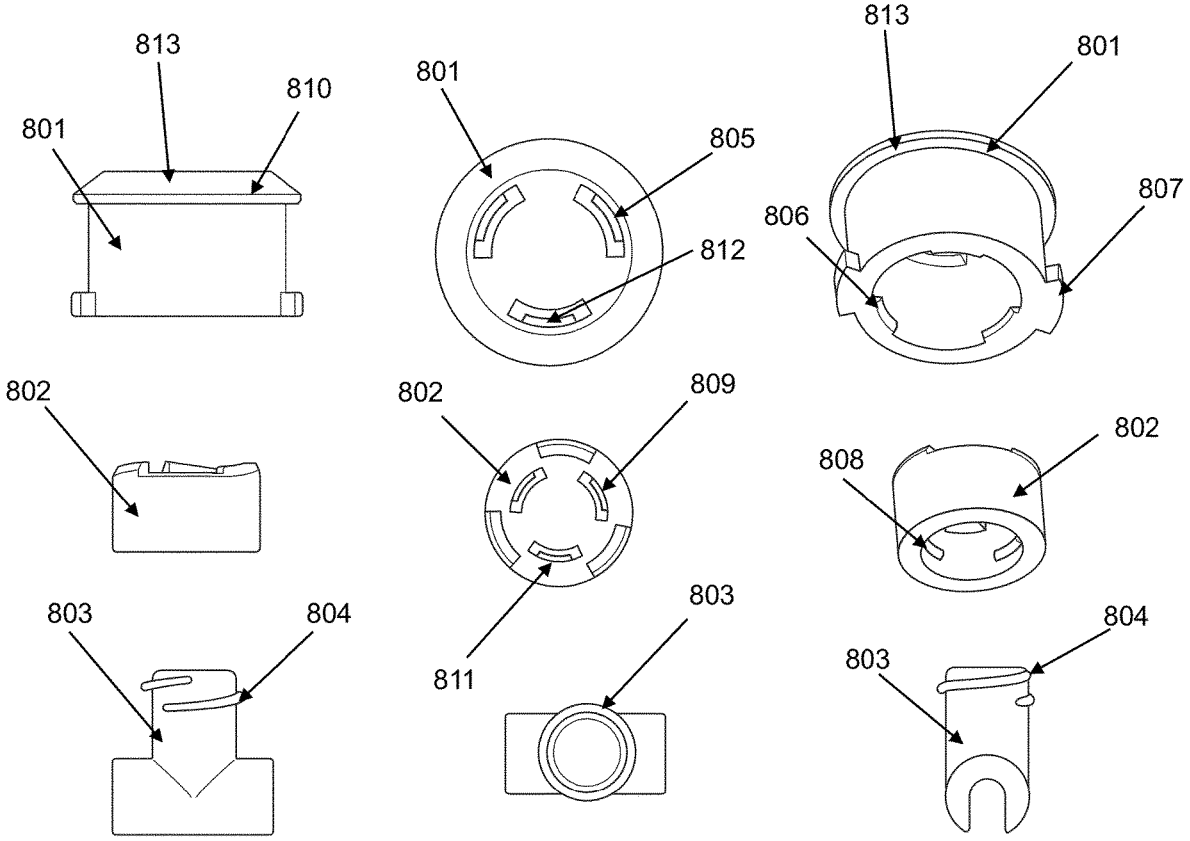
FIG. 22 is a view of the component parts of the head attachment apparatus.

FIG. 22 shows a detailed view of head attachment cover 801, head attachment base 802 and threaded neck post 803. Threaded neck post 803 is formed on or attached to retaining shoulder. Retaining shoulder attaches directly to the internal skeleton of plush doll 800. Threaded neck post 803 includes external threads 804. External threads couple with complementary internal threads 808 located on the internal structure of head attachment base 802. When located over threaded neck post 803 and rotated, head attachment base 802 couples with an secures to threaded neck post 803.

Head attachment base 802 also comprises one or more keyed slots 809. The embodiment shown includes three keyed slots 809. These keyed slots 809 are openings shaped to couple with complementary keyed tabs 805 located in head attachment cover 801. The keyed slots 809 also include locking tabs 811. Further, keyed tabs 805 also include locking tabs 812. To attach the dolls head to the body, head attachment cover 801 is placed over head attachment base 802 such that keyed tabs 805 are fitted through keyed slots 809. When head attachment cover 801 is pressed down and rotated, locking tabs 811 of keyed slots 809 engage with locking tabs 812 of keyed tabs 805. This engagement locks the two sets of locking tabs 811 and locking tabs 812 together, thus securing head attachment cover 801 to head attachment base 802. To remove head attachment cover 801 from head attachment base 802, the opposite motion is performed: head attachment cover 801 is pressed downward and rotated in the opposite direction from when engaging. The rotation disengages locking tabs 811 from locking tabs 812 and unlocks head attachment cover 801 from head attachment base 802. Then head attachment cover 801 may be removed from head attachment base 802.

Head attachment cover 801 forms post 810 that fits within the head of the toy (not shown). Lip 813 fits through the opening of head (not shown) to secure post 810 to head. Further, tab 807 fits within complementary sized slots formed on head (not shown) to secure the head rotationally to post to allow it to be rotated. The rotation allows the head to be attached and removed as described.

Figure 23:
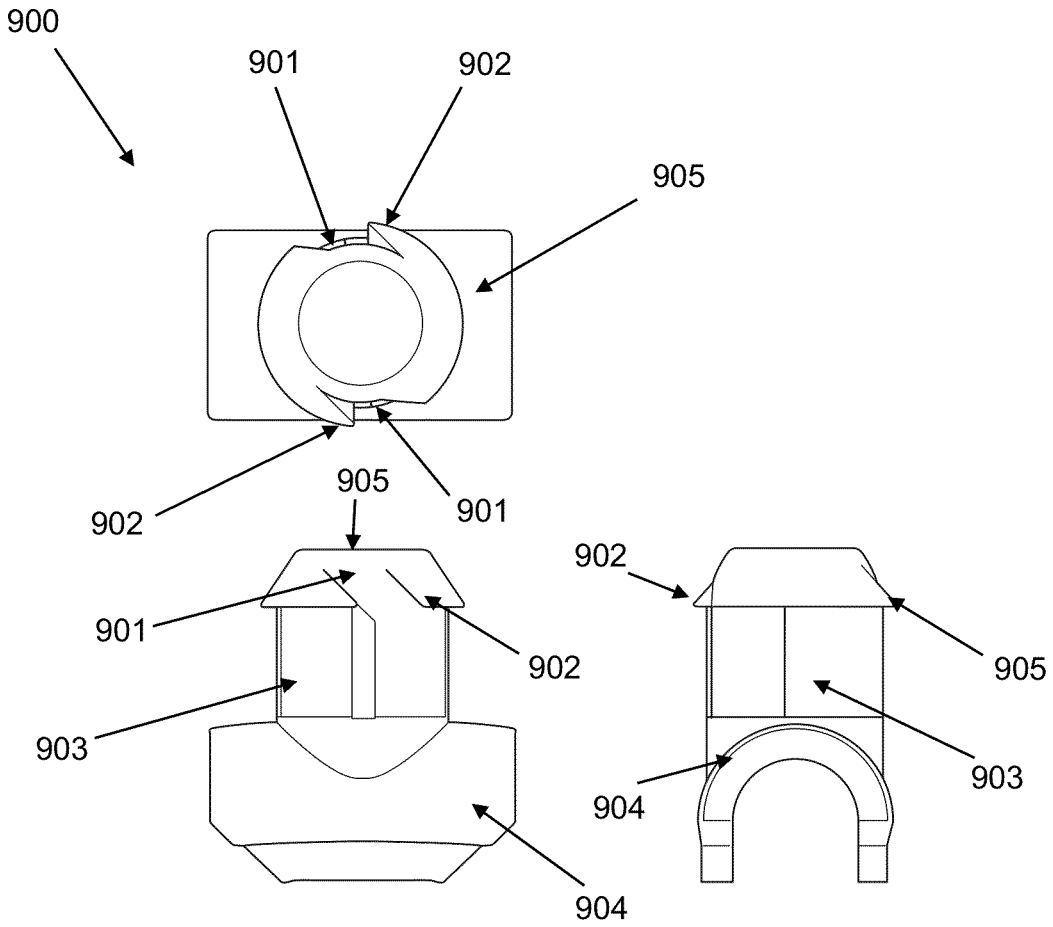
FIG. 23 is a view of an alternative embodiment of a head attachment post.

FIG. 23 shows an alternate embodiment of head attachment post 900. This embodiment includes a notched lip 905 at the top of post 903. Notched lip 905 is comprised of lip 902 and notch 901. The notched lip 905 allows for more secure attachment of the doll head (made of PVC or plastic in the preferred embodiment) to head attachment post 900. Head attachment post 900 further comprises retaining shoulder 904, which attaches to the internal skeleton.

Figure 24:
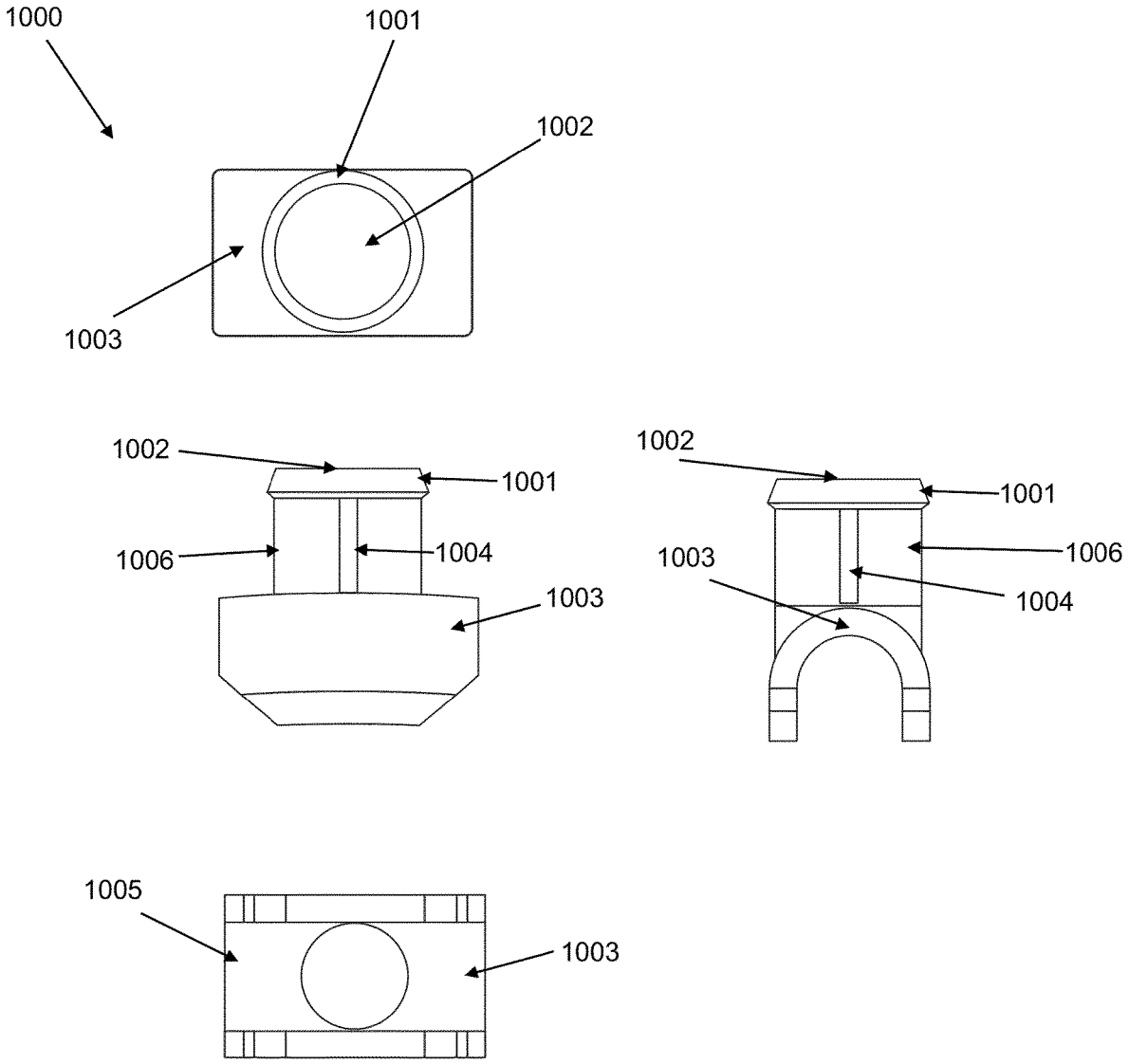
FIG. 24 is a view of an alternative embodiment of a head attachment post.

FIG. 24 shows, from the top left in a clockwise direction, a top view, a side view, a bottom view, and a front view of an an alternative embodiment of head attachment post 1000. Head attachment post 1000 is comprised of closed top 1002, lip 1001, seam 1004 and post 1006. Post 1006 is attached to the top of retaining shoulder 1003. Closed top 1002 and lip 1001 fit within the head of the doll (in the preferred embodiment made of PVC or plastic) and snaps into a complementary cavity in the head. Once snapped in place in the head, post 1006 provides secure attachment of the head to retaining shoulder 1003 which is further coupled to the skeleton of the doll, while allowing rotation of the doll head. This alternative embodiment of head attachment post 1000 may be combined with any version of the retaining shoulders disclosed and discussed in reference to FIG. 20.

This embodiment of head attachment post 1000 is improved by the top of the post being closed and solid with closed top 1002 versus other embodiments with an open top post. This feature improves the structure of the overall doll reducing the issue of loose structure. Additionally, inclusion of seam 1004 provides additional stability to the structure further improving the structure and reducing the feeling of loose attachment between the head and body of the doll. Neck rotation for this embodiment is more secure and stability is improved.

Figure 25:
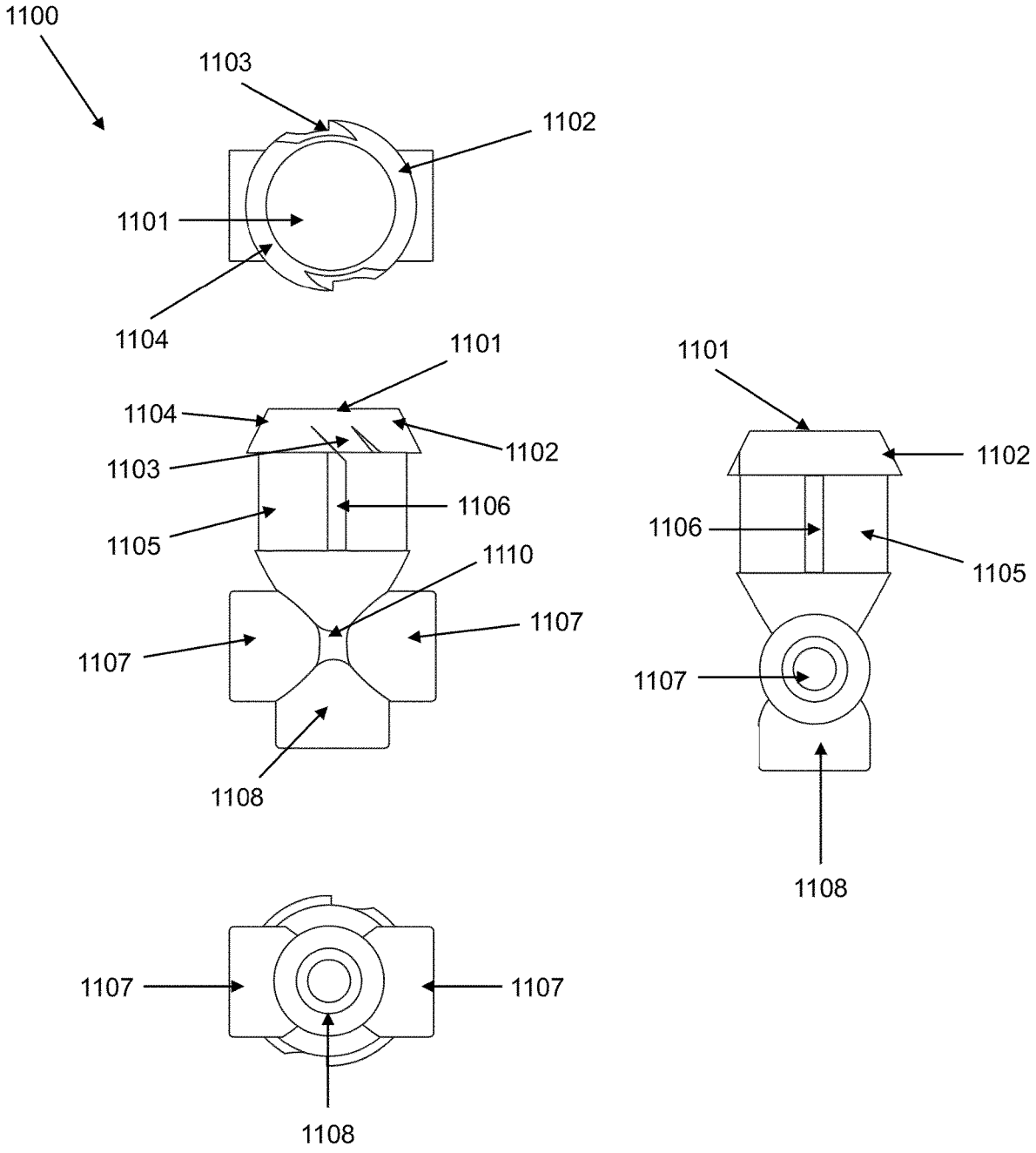
FIG. 25 is a view of an alternative embodiment of a central limb connector.

FIG. 25 shows, from the top left in a clockwise direction, a top view, a side view, a bottom view, and a front view of an alternate embodiment of head and skeleton attachment post 1100. This embodiment includes an improved post 1105 and an improved central body connector 1110. In this embodiment, improved post 1105 is comprised of closed top 1101, notched lip 1104 and seam 1106. Notched lip 1104 is comprised of lip 1102 and notch 1103. The notched lip 1104 allows for more secure attachment of the doll head (made of PVC or plastic in the preferred embodiment) to post 1105.

This embodiment of head and skeleton attachment post 1100 is improved by the top of the post being closed and solid with closed top 1101 versus other embodiments with an open top post. This feature improves the structure of the overall doll reducing the issue of loose structure. Additionally, inclusion of seam 1106 provides additional stability to the structure further improving the structure and reducing the feeling of loose attachment between the head and body of the doll. Neck rotation for this embodiment is more secure and stability is improved.

Central body connector 1110 is comprised of arm connectors 1107 and body connector 1108. Arm connectors 1107 connect to arm portion of the skeleton of the doll (not shown) and body connector 1108 connects to the body elements of the doll skeleton. Central body connector 1110 includes a reduced size in the center region with narrowed connections for arm connectors 1107 and body connector 1108. This design allows for improved filing of the doll body with stuffing. This improved design head and skeleton attachment post 1100 may be used with any design of head or skeleton disclosed herein.

Figure 26:
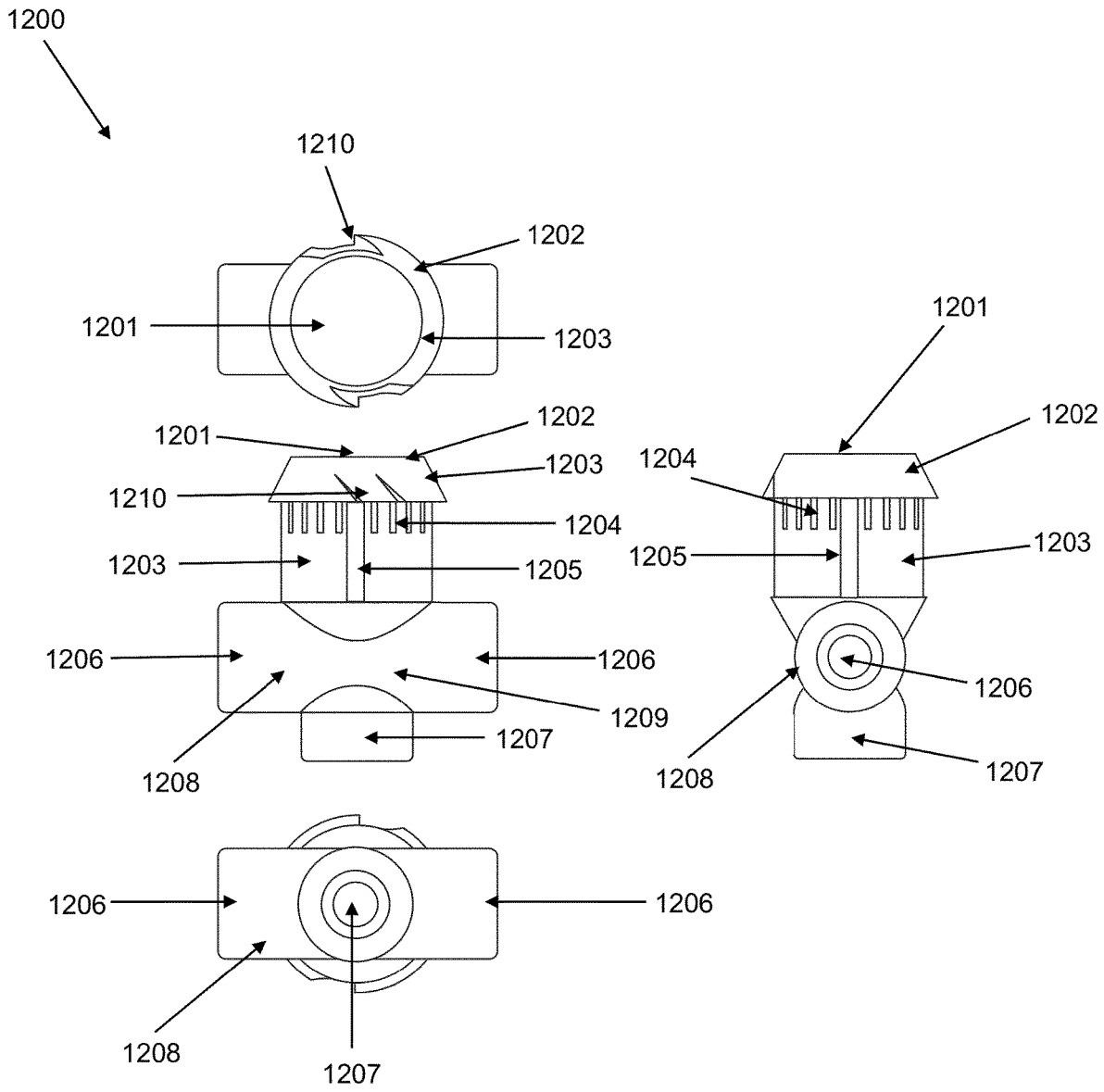
FIG. 26 is a view of an alternative embodiment of a central limb connector.

FIG. 26 shows, from the top left in a clockwise direction, a top view, a side view, a bottom view, and a front view of an alternate embodiment of head and skeleton attachment post 1200. This embodiment includes an improved post 1203 and an improved central body connector 1208. In this embodiment, improved post 1203 is comprised of closed top 1201, notched lip 1202, filing lines 1204 and seam 1205. Notched lip 1202 is comprised of lip 1203 and notch 1210. The notched lip 1202 allows for more secure attachment of the doll head (made of PVC or plastic in the preferred embodiment) to post 1203.

This embodiment of head and skeleton attachment post 1200 is improved by the top of the post being closed and solid with closed top 1201 versus other embodiments with an open top post. This feature improves the structure of the overall doll reducing the issue of loose structure. Additionally, inclusion of seam 1205 provides additional stability to the structure further improving the structure and reducing the feeling of loose attachment between the head and body of the doll. Neck rotation for this embodiment is more secure and stability is improved. Further, the addition of filing lines 1204 provide guidance for when the body has been filled appropriately with whatever filing is used in that embodiment of the doll.

Central body connector 1208 is comprised of arm connectors 1206 and body connector 1207. Arm connectors 1206 connect to arm portion of the skeleton of the doll (not shown) and body connector 1207 connects to the body elements of the doll skeleton. Central body connector 1208 includes text location 1209 where any text may be printed or stamped on the skeleton such as model number, serial number or any other relevant text. This improved design head and skeleton attachment post 1200 may be used with any design of head or skeleton disclosed herein.

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A plush toy with a head and a body comprising:

a flexible internal skeleton;

a plush body cover being formed of a first material, the plush body cover comprising the body of the plush toy and having at least one opening for attachment of a head for the toy, the plush cover further being configured to cover the skeleton and to retain a stuffing material for the plush toy;

a central limb connector comprising an arm connector and a body connector, wherein the arm connector and the body connector are configured to couple with the skeleton;

a plush material retaining shoulder comprising a neck connector configured to couple and decouple with a neck receptacle in the head of the toy, the neck connector further comprising a seam and allowing attachment and detachment of the head from the body of the plush toy; and the head of the plush toy being formed of a second material.

2. The plush toy of claim 1 where the neck connector has a closed top.

3. The plush toy of claim 1 where the flexible internal skeleton is comprised of one or more individual skeleton pieces each with a first end and a second end, where the first end of one skeleton piece connects to the second end of a second skeleton piece.

4. The plush toy of claim 1 where the flexible skeleton is formed of wire.

5. The plush toy of claim 1 where the first material is selected from the group consisting of plush material, soft boa fabric, tricot fabric, pearl velvet cloth, wide wale soft boa, polar fleece, velboa, printed polyester, pile textiles, cotton, mohair, wool, worsted yarn, simulated fur, real fur, silk with a cotton backing, and terry cloth.

6. The plush toy of claim 1 where the second material is selected from the group consisting of PVC, plastic, rubber and metal.

7. The plush toy of claim 1 where the stuffing material is selected from the group comprising polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

8. A plush toy with a head and a body comprising:

a flexible internal skeleton;

a plush body cover being formed of a first material, the plush body cover comprising the body of the plush toy and having at least one opening for attachment of a head for the toy, the plush cover further being configured to cover the skeleton and to retain a stuffing material for the plush toy;

a central limb connector comprising an arm connector and a body connector, wherein the arm connector and the body connector are configured to couple with the skeleton, the central limb connector further comprising a neck connector configured to couple and decouple with a neck receptacle in the head of the toy, the neck connector further comprising a closed top and a seam, and allowing attachment and detachment of the head from the body of the plush toy; and the head of the plush toy being formed of a second material.

9. The plush toy of claim 8 where the neck connector further comprises a notched lip.

10. The plush toy of claim 8 where the arm connector and body connector are coupled to a center of the central limb connector and where the arm connector and body connector have a tapered shape at the coupling with the center of the body connector.

11. The plush toy of claim 8 where the central limb connector includes a text location.

12. The plush toy of claim 8 where the neck connector further comprises a filing line.

13. The plush toy of claim 8 where the flexible internal skeleton is comprised of one or more individual skeleton pieces each with a first end and a second end, where the first end of one skeleton piece connects to the second end of a second skeleton piece.

14. The plush toy of claim 8 where the flexible skeleton is formed of wire.

15. The plush toy of claim 8 where the first material is selected from the group consisting of plush material, soft boa fabric, tricot fabric, pearl velvet cloth, wide wale soft boa, polar fleece, velboa, printed polyester, pile textiles, cotton, mohair, wool, worsted yarn, simulated fur, real fur, silk with a cotton backing, and terry cloth.

16. The plush toy of claim 8 where the second material is selected from the group consisting of PVC, plastic, rubber and metal.

17. The plush toy of claim 8 where the stuffing material is selected from the group comprising polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

* * * * *